US006602561B1

(12) United States Patent
Moro et al.

(10) Patent No.: US 6,602,561 B1
(45) Date of Patent: Aug. 5, 2003

(54) ELECTRODE FOR DISCHARGE SURFACE TREATMENT AND MANUFACTURING METHOD THEREFOR AND DISCHARGE SURFACE TREATMENT METHOD AND DEVICE

(75) Inventors: Toshio Moro, Tokyo (JP); Akihiro Goto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/462,793

(22) PCT Filed: May 13, 1999

(86) PCT No.: PCT/JP99/02460

§ 371 (c)(1),
(2), (4) Date: Jun. 20, 2000

(87) PCT Pub. No.: WO99/58744

PCT Pub. Date: Nov. 18, 1999

(30) Foreign Application Priority Data

May 13, 1998 (JP) ..... 10-130318
Oct. 23, 1998 (JP) ..... 10-302020
Oct. 27, 1998 (JP) ..... 10-304898

(51) Int. Cl.[7] ..... B32B 35/00; B23H 7/22; B23H 7/24; B29C 67/04

(52) U.S. Cl. ..... 427/580; 427/140; 427/142; 118/723 VE; 219/69.15; 219/69.17; 264/125; 142/224; 29/868; 29/DIG. 8; 29/DIG. 49

(58) Field of Search ..... 427/540, 580, 427/140, 142; 148/224; 204/192.38, 298.41; 264/125; 29/825, 868, DIG. 8, DIG. 49; 118/723 E, 723 VE; 219/69.15, 69.16, 69.17

(56) References Cited

U.S. PATENT DOCUMENTS 3,553,527 A * 1/1971 Gutsche ..... 264/29.6
3,857,012 A * 12/1974 Stegelman et al. ..... 219/69 E
4,027,134 A * 5/1977 Arakawa ..... 219/69 E (List continued on next page.)

FOREIGN PATENT DOCUMENTS

DE 44 36 663 4/1995
DE 44 42 161 3/1996
DE 197 01 170 7/1997

(List continued on next page.)

OTHER PUBLICATIONS

Translation of JP 62–127,448A (Sekiguchi) Jun. 1987.*
Translation of JP 59–107825A (Gotoo), Jun. 1984.*
Translation of German patent #44 42 161C1 (Prause), Mar. 1996.*

(List continued on next page.)

*Primary Examiner*—Marianne Padgett
(74) *Attorney, Agent, or Firm*—Sughrue Mion, PLLC

(57) ABSTRACT

A discharge surface treatment method with which discharge is caused to occur between an electrode and a workpiece to generate energy to form a coating on a surface of the workpiece, and method therefore. An electrode is made by combining a hard material, such as WC, and a soft material, such as Co. The hard and soft materials are mixed and compressed into a green compact. The green compact is baked in a vacuum furnace at a temperature which is below the sintering temperature but high enough to melt the soft material. The melted soft material fills the gaps between the particles of the hard material, resulting in an electrode having a texture similar to chalk called incomplete-sintering. The electrode is then used in discharge surface treatment.

24 Claims, 21 Drawing Sheets

U.S. PATENT DOCUMENTS

| | | | | | |
|---|---|---|---|---|---|
| 4,153,755 | A | * | 5/1979 | Rothkegel et al. | 428/569 |
| 4,373,127 | A | * | 2/1983 | Haskett et al. | 219/69 E |
| 4,649,086 | A | * | 3/1987 | Johnson | 427/580 |
| RE32,464 | E | * | 7/1987 | Aine | |
| 4,978,556 | A | * | 12/1990 | Pinkahsov | 427/580 |
| 5,010,563 | A | * | 4/1991 | Laurent et al. | 378/132 |
| 5,651,901 | A | | 7/1997 | Mohri et al. | 219/69.17 |
| 5,736,076 | A | * | 4/1998 | Meissner et al. | |
| 5,858,479 | A | * | 1/1999 | Saito et al. | 427/580 |
| 6,086,684 | A | * | 7/2000 | Saito et al. | 427/580 |
| 6,437,278 | B1 | * | 8/2002 | Inoue et al. | 219/69.15 |
| 6,441,333 | B1 | * | 8/2002 | Goto et al. | 219/69.15 |
| 6,492,611 | B2 | * | 12/2002 | Goto et al. | 219/69.17 |

FOREIGN PATENT DOCUMENTS

| | | | | |
|---|---|---|---|---|
| JP | 359107825 A | * | 6/1984 | |
| JP | 62-116741 | | 5/1987 | C22C/9/00 |
| JP | 62127448 A | * | 6/1987 | |
| JP | 7-112329 | | 5/1995 | B23H/9/00 |
| JP | 7-197275 | | 8/1995 | C23C/26/00 |
| JP | 7-278781 | | 10/1995 | C23C/4/12 |
| JP | HEI. 8-300227 | | 11/1996 | |
| JP | 9-108834 | | 4/1997 | B23K/9/04 |
| JP | 9-192937 | | 7/1997 | B23H/9/00 |
| JP | 10-512 | | 1/1998 | B23H/9/00 |

OTHER PUBLICATIONS

Translation of JP 8–300227 (Saito et al), Nov. 1996.*

Translation of JP 11–827 (Saito et al), Jan. 1999.*

Hawley's Condensed Chemical Dictionary, 12$^{th}$ Edition, R.J. Lewis, Sr. Ed., Van Nostrand Reinhold Co., NY; p. 871 p526, 1993 No Month.*

Abstract Only—No Patent Document Supplied for JP6212447 Jun. 9, 1987, to Sekicuchi Shigeaki.

* cited by examiner

IMAGE OF SEI

IMAGE OF Ti-Kα

□ : TiC

○ : WC

△ : $Co_3W_9C_4$

COMPARISON OF TIME REQUIRED TO MANUFACTURE MOLD FOR CONNECTING ROD

ELECTRODE FOR DISCHARGE SURFACE TREATMENT AND MANUFACTURING METHOD THEREFOR AND DISCHARGE SURFACE TREATMENT METHOD AND DEVICE

TECHNICAL FIELD

The present invention relates to improvements in an electrode for use in electrical discharge surface treatment, arranged to cause discharge to take place between the electrode and a workpiece. The discharge energy is used to form a hard coating on the surface of the workpiece. Also disclosed are a manufacturing method therefor, a discharge surface treatment method and an apparatus therefor.

BACKGROUND ART

Hitherto, as a technique for coating the surface of a work to impart corrosion resistance and wear resistance to the surface, a discharge surface treatment method has been disclosed in, for example, Japanese Patent Unexamined Publication No. Hei. 5-148615. The foregoing technique uses an electrode in the form of a green compact composed of WC powder and Co powder so that a primary step (a depositing step) is performed. Then, a secondary step (a re-melting step) is performed after the electrode has been changed. The second electrode, may be, e.g., a copper electrode whose electrode wear is comparatively small. Thus, the foregoing method requires two steps to complete the treatment of the surface of a metal material. This conventional technique is excellent when it is used to form, on a steel material, a hard coating exhibiting satisfactory hardness and adhesiveness and having a thickness of tens of $\mu$m. However, the method encounters difficulty when a hard coating having sufficient adhesiveness is to be formed on a sintered material, such as a hard alloy.

A discharge surface treatment method disclosed in Japanese Patent Unexamined Publication No. Hei. 9-192937, which is capable of forming a hard coating having sufficient adhesiveness on a hard alloy will now be described with reference to FIG. 16. Referring to FIG. 16, reference numeral 1 represents an electrode in the form of a green compact manufactured by compressing $TiH_2$ powder, 2 represents a workpiece, 3 represents a working tank, 4 represents a working fluid and 5 represents a switching element for switching the voltage and current which are applied to the electrode 1 and the workpiece 2. Reference numeral 6 represents a control circuit for on/off controlling of the switching element 5. Reference numeral 7 represents a power source, 8 represents a resistor and 9 represents a formed hard coating. The discharge surface treatment performed with the foregoing structure enables a hard coating exhibiting excellent adhesiveness and having a thickness of several $\mu$m to tens of $\mu$m to be formed on the surface of steel or a hard alloy.

Each of the foregoing conventional techniques are characterized by using an electrode in the form of a green compact, and has an advantage in that components of the electrode can easily be melted due to the discharge energy, permitting a coating to easily be formed on the surface of the workpiece. However, the following three reasons have inhibited practical use of the foregoing method.

A first reason will now be described. The electrode in the form of the green compact is brittle and susceptible to damage. Therefore, machining to adapt the electrode to the shape of the workpiece, or machining to form screw holes for securing the electrode to the apparatus cannot easily be performed. Thus, the preparatory operations for the discharge surface treatment become too complicated, causing a substantial deterioration in the process efficiency. To overcome the above-mentioned problem, it might be feasible to sinter the electrode, in the form of the green compact, into a metal electrode for use. However, there arises a problem in that the processability of the sintered electrode deteriorates and a speed at which the hard coating can be formed is reduced.

A second reason will now be described. An electrode having a size satisfactory from the viewpoint of practical use cannot easily be formed. That is, an electrode arranged to be used in the surface treatment of a mold or the like and having a satisfactorily large size can be formed only when a high performance press is employed. Moreover, the fact that the pressure cannot be uniformly transmitted in the material when the powder material is compressed causes irregularities in the density to occur. Therefore, there arises a problem of, for example, cracks. Hence, it follows that the non-uniform hard coating formed on the workpiece results in a poorer quality product.

A third reason will now be described. A thick film cannot easily be formed. The conventional method cannot form a coating, the thickness of which is larger than several $\mu$m to tens of $\mu$m. A hard coating having a thickness larger than the above-mentioned value, required by industry, cannot be formed.

An elaboration will be given regarding the third reason above. Thin film formation has industrially been performed by physical evaporation, or chemical evaporation which is a dry process. A thick film cannot be formed by the foregoing method. Therefore, spray coating or the like must be employed at present. Spray coating methods capable of coating a variety of materials on a workpiece suffer from coarse texture of the formed coating. Therefore, spray coating cannot be applied in situations requiring precision and durability, such as forming a coating on a mold. The materials which can be spray coated are also excessively limited.

A conventional technique has been disclosed in Japanese Patent Unexamined Publication No. Hei. 8-300227 which relates to an electrode for discharge surface treatment and a method of surface treatment for a metal material. This method has the steps of using carbide, compressing it into an electrode and performing temporal sintering at a temperature lower than the sintering temperature so that an electrode is formed. The method is arranged to change the machining polarity after the discharge surface treatment has been performed to perform a process for further hardening the hard coating. Therefore, the temporal sintering process must be performed at a comparatively high temperature. This process demands that a temperature of 1100° C. is maintained for 30 minutes. Since dense textures have been formed in the foregoing electrode, and manufactured by the temporal sintering process, secondary machining of the electrode cannot be easily performed. Unfortunately, the hard coating cannot be efficiently deposited on a workpiece, resulting in poor quality of the hard coating. When a dense hard coating is required, the machining operation must be performed for a long time. The foregoing method has another problem in that the depositing process is easily shifted to a profile-discharge process.

A method of manufacturing a mold will now be described as an example of the workpiece. The mold can be manufactured by any one of the following three methods. A first method is arranged such that a mold is subjected to heat treatment to impart required hardness and wear resistance. A second method uses surface modifying techniques to deposit a hard coating on a portion, or the overall surface of the mold, to prolong the mold's lifetime. A third method uses a hard alloy or the like to manufacture the mold to maintain the accuracy of the mold for a long time. The third method is employed to manufacture a mold for automobiles or the like which are mass-produced, or to manufacture precise products.

In the present invention, a discharge surface treatment method is employed when a mold is the workpiece which must be processed according to the third method. According to the present invention, a discharge surface treatment method is provided for a mold which is interchangeable with or substitutable for a mold made of a hard alloy or a mold which partially uses the hard alloy. A conventional technique will now be described.

FIG. 17 shows an example of a mold for a die header which is used as a mold a precise forging process. A hard alloy block 101 is embedded in the central portion of a base metal 100 and machined by a profile discharge machine or a wire discharge machine to provide the actual mold surface. Additionally, a discharge surface treatment is performed to deposit a hard coating on the surface of the mold to increase the hardness of the surface which improves the durability of the mold. FIG. 17 shows the structure which is used when the discharge surface treatment is performed. A discharge surface treatment uses an electrode 103 in the form of a green compact to produce a hard coating on the surface of the mold having a thickness of about several $\mu$m. Reference numeral 102 represents a shank for securing the electrode 103. As described above, the mold is manufactured by a plurality of steps including machining the base metal for the mold, embedding the hard alloy block, precise machining of the shape of the mold and discharge surface treatment for improving the surface of the mold.

The foregoing process for manufacturing the mold has two critical problems. A first problem arises due to the hard alloy block being force-fitted into the base material of the mold. Therefore, both of the base material of the mold and the hard alloy block must be machined with considerably excellent accuracy. Therefore, a long time and a great cost are required to manufacture the mold. A second problem is caused from a fact that the hard alloy block is made of a different material than the base material of the mold. As a result, the difference in the coefficient of thermal expansion causes cracks and breakage to easily occur. If the hard alloy block cannot be used due to breakage or cracks, the mold must be discarded or re-manufactured. Also, a long time and a great cost are required to manufacture the mold.

Therefore, a need for improvement is called for by a department which manufactures the molds and/or a department which uses the molds. However, an effective solution has not been provided.

Another case will now be described. In the automobile parts manufacturing industry, a mold for forging a connecting rod structured, for example, as shown in FIG. 18, is widely used. FIG. 19 shows a representative manufacturing process in the foregoing case. Recently, a high speed cutting technique has rapidly been improved. Therefore, a hard workpiece obtained by heat treatment can be subjected to a cutting operation. FIG. 20 shows results of a comparison of the time required to manufacture connecting rod molds between the high-speed cutting operation and the conventional discharge machining operation. As can be understood from FIG. 20, the high-speed cutting operation is more efficient than the conventional discharge machining operation.

Since the mold wears after it has been used as shown in 5 of FIG. 19, changing to a new mold or improving the accuracy of the worn mold is required. In a case of a large mold, as shown in FIG. 18, the hard alloy block cannot easily be embedded. A major portion of large molds of the foregoing type is usually made of die steel. Therefore, if the die-steel mold has been worn, heat treatment and surface improvement can only be partially performed to improve the durability. Therefore, the frequency of re-manufacturing the molds is raised excessively, causing the cost of manufacturing the mold to be dramatically increased.

The conventional method of forming a hard coating to a workpiece, such as a mold, by performing discharge surface treatment has been structured as described in Japanese Patent Unexamined Publication No. Hei. 5-148615.

The conventional method, however, suffers from thin thickness of the hard coating as shown in FIG. 21, deterioration in the characteristics of the material at high temperatures due to plastic deformation and insufficient tenacity. Therefore, it is difficult to use the mold having the hard coating formed thereon as a substitute for the hard alloy block. Therefore, the foregoing hard coating has been limitedly used to improve the surface of a hard alloy.

As described above, there arises a problem of increased time and manufacturing costs needed to manufacture the mold made of the hard alloy. In a case of a large mold into which the hard alloy block cannot be embedded, there arises a problem of increased frequency of re-manufacturing the molds and, therefore, the cost for manufacturing the mold cannot be reduced. The conventional method of forming the hard coating by the discharge surface treatment suffers from an unsatisfactorily small thickness. Therefore, the problems could not be previously overcome.

DISCLOSURE OF THE INVENTION

The present invention solves the above-mentioned problems experienced with the conventional techniques, and an object of the present invention is to obtain an electrode for discharge surface treatment which can easily be secondary-machined and which is free from reduction in a forming rate of a hard coating.

Another object of the present invention is to obtain an electrode for discharge surface treatment which is capable of forming, on a workpiece, a hard coating, which is capable of imparting special functions including lubricity, strength against high temperatures and wear resistance.

Another object of the present invention is to obtain an electrode for discharge surface treatment which is capable of forming a high-quality hard coating on a workpiece.

Another object of the present invention is to obtain a discharge surface treatment method which is capable of efficiently forming a hard coating on a workpiece, easily forming an electrode, forming a thick film of a hard coating in an arbitrary range of an area which is applicable to a variety of mechanical elements including molds, tools and mechanical parts.

Another object of the present invention is to obtain a discharge surface treatment method which is applied to a mold as a substitute for a mold made of a hard alloy, which exhibits a low cost, high accuracy and excellent durability, which can be quickly manufactured and which can be used repeatedly using only a simple repairing operation.

Since the present invention is structured as described above, the following effects can be obtained.

The electrode for discharge surface treatment according to the first invention attains an effect that it can easily be formed by a mechanical removing process, such as a turning operation, a grinding operation or a polishing operation or a discharging process. Moreover, a discharge surface treatment using the electrode can be performed such that a rate at which the hard coating which is formed on the work is formed is not reduced.

The electrode for discharge surface treatment according to the second invention attains an effect similar to that obtainable from the first invention and another effect that formability in the compression forming can significantly be improved.

The electrode for discharge surface treatment according to the third invention attain an effect similar to that obtainable from the first invention or the second invention.

The electrode for discharge surface treatment according to the fourth invention attains an effect similar to that obtainable from the first invention or the second invention and another effect that a hard coating capable of imparting special functions including lubricity, strength against high temperatures and wear resistance can be formed on a work by the discharge surface treatment using the electrode.

The electrode for discharge surface treatment according to the fifth invention attains an effect similar to that obtainable from the first invention or the second invention and another effect that a denser and high-quality hard coating free from irregularity of the hardness can be formed on a work by the discharge surface treatment using the electrode.

The method of manufacturing the electrode for discharge surface treatment according to the sixth invention attains an effect that an electrode for discharge surface treatment can be obtained which can easily be formed by a mechanical removing process, such as a turning operation, a grinding operation or a polishing operation or a discharging process and another effect that the discharge surface treatment using the electrode can be performed such that a rate at which the hard coating which is formed on the work is formed is not reduced.

The method of manufacturing the electrode for discharge surface treatment according to the seventh invention attains an effect similar to that obtainable from the sixth invention and another effect that the formability in the compression forming can significantly be improved.

The method of manufacturing the electrode for discharge surface treatment according to the eighth invention attains an effect similar to that obtainable from the sixth invention or the seventh invention.

The method of manufacturing the electrode for discharge surface treatment according to the ninth invention attains an effect similar to that obtainable from the sixth invention or the seventh invention. Moreover, another effect can be obtained in that a hard coating capable of imparting special functions including lubricity, strength against high temperatures and wear resistance can be formed on a work by the discharge surface treatment using the electrode.

The method of manufacturing the electrode for discharge surface treatment according to the tenth invention attains an effect similar to that obtainable from the sixth invention or the seventh invention. Moreover, another effect can be obtained in that a denser and high-quality hard coating free from irregularity of the hardness can be formed on a work by the discharge surface treatment using the electrode.

The discharge surface treatment method according to the eleventh and twelfth inventions attains an effect that the electrode for discharge surface treatment can easily be formed, a hard coating can efficiently be formed on a work and a discharge surface treatment method can be obtained which can be applied to a variety of mechanical parts including a mold, a tool and a mechanical element. Another effect can be obtained in that the masking process is not required because the hard coating can be formed in an area of the work which is substantially the same as the area of the electrode.

The discharge surface treatment method according to the thirteenth invention attains an effect similar to that obtainable from the eleventh invention and another effect that the structure can be simplified.

The discharge surface treatment method according to the fourteenth invention attains an effect similar to that obtainable from the eleventh invention. Another effect can be obtained in that machining can be performed while a small-size electrode is being scanned, a necessity for using a large-size and special-shape sintered electrode can be eliminated, the small-size electrode can be scanned on the overall curved surface of a work, such as a mold, having a three-dimensional free curved surface and a hard coating can be formed having the same thickness over the area of the work or such that the thickness is changed if necessary.

The discharge surface treatment method according to the fifteenth invention attains an effect similar to that obtainable from the eleventh invention. Another effect can be obtained in that a hard coating capable of imparting special functions including lubricity, strength against high temperatures and wear resistance can be formed on a work by the discharge surface treatment using the electrode.

The discharge surface treatment method according to the sixteenth invention attains an effect similar to that obtainable from the eleventh invention and another effect that a denser and high-quality hard coating free from irregularity of the hardness can be formed on a work by the discharge surface treatment using the electrode.

The discharge surface treatment method according to the seventeenth invention attains an effect similar to that obtainable from the eleventh invention and another effect that a mold coated with a hard coating which can be manufactured in a short time, the cost of which can be reduced and which exhibits satisfactory accuracy can be obtained. Another effect can be obtained in that a mold coated with a hard coating exhibiting excellent durability and repeated use of which is permitted with a simple modifying operation if the mold is worn.

The discharge surface treatment method according to the eighteenth invention attains an effect similar to that obtainable from the seventeenth invention. Another aspect can be obtained in that a mold coated with a hard coating exhibiting furthermore satisfactory durability can be obtained because a hard coating thicker than a hard coating formed in a portion of the mold in which the degree of wear is low is formed in a portion of the same in which the degree of wear is high.

The discharge surface treatment method according to the nineteenth invention attains an effect similar to that obtainable from the seventeenth invention. Another effect can be obtained in that a mold coated with a hard coating can be obtained with which re-manufacturing of the mold is not required, semipermanent use of the mold is permitted, costs required to manufacture the mold and maintain the same can considerably be saved and saving of energy and environmental friendliness are permitted because the amount of the material for manufacturing the mold can considerably be reduced.

The discharge surface treatment method according to the twentieth invention attains an effect similar to that obtainable from the nineteenth invention and another effect that modification of the mold can be completed in a considerably short time.

The discharge surface treatment apparatus according to the twenty-first and twenty-second inventions attains an effect that a discharge surface treatment apparatus can be obtained with which the electrode for discharge surface treatment can easily be formed, a hard coating can efficiently be formed on a work and adaptation to a variety of mechanical parts including a mold, a tool and a mechanical element is permitted. Another effect can be obtained in that the masking process is not required because the hard coating can be formed in an area of the work which is substantially the same as the area of the electrode.

The discharge surface treatment apparatus according to the twenty-third invention attains an effect similar to that obtainable from the twenty-first invention and another effect that the apparatus can be simplified.

The discharge surface treatment apparatus according to the twenty-fourth invention attains an effect similar to that obtainable from the twenty-first invention. Another effect can be obtained in that machining can be performed while a small-size electrode is being scanned, a necessity for using a large-size and special-shape sintered electrode can be eliminated, the small-size electrode can be scanned on the overall curved surface of a work, such as a mold, having a three-dimensional free curved surface and a hard coating can be formed having the same thickness over the area of the work or such that the thickness is changed if necessary.

DETAILED DESCRIPTION OF THE PREFERRED EMBODIMENT

First Embodiment

Figure 1:
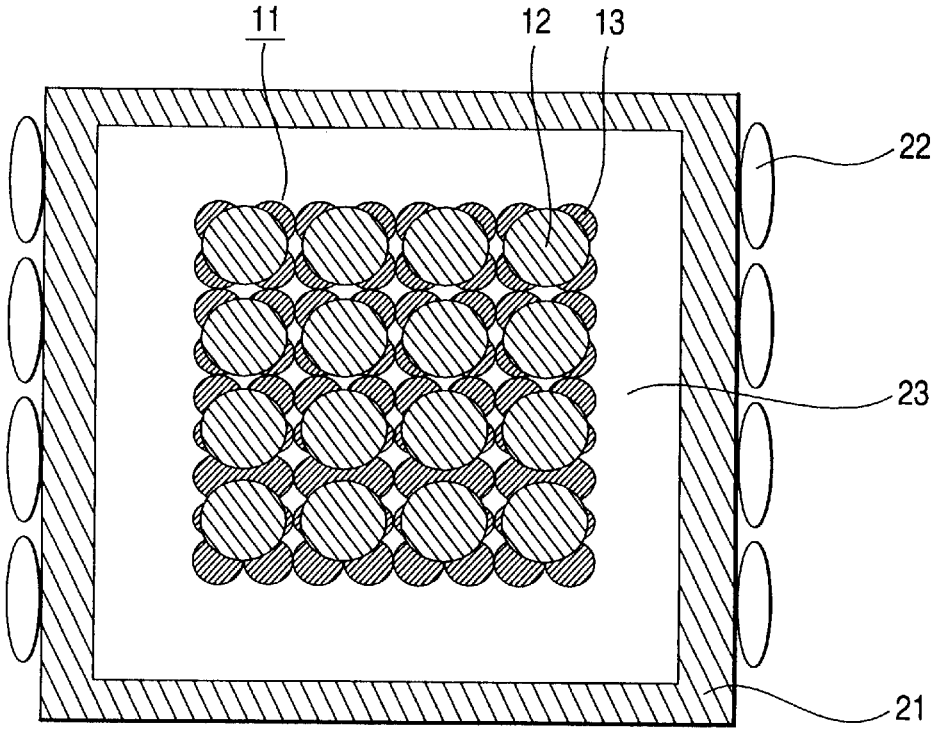
FIG. 1 is a diagram showing a method of manufacturing an electrode for discharge surface treatment according to a first embodiment of the present invention.
Figure 1:
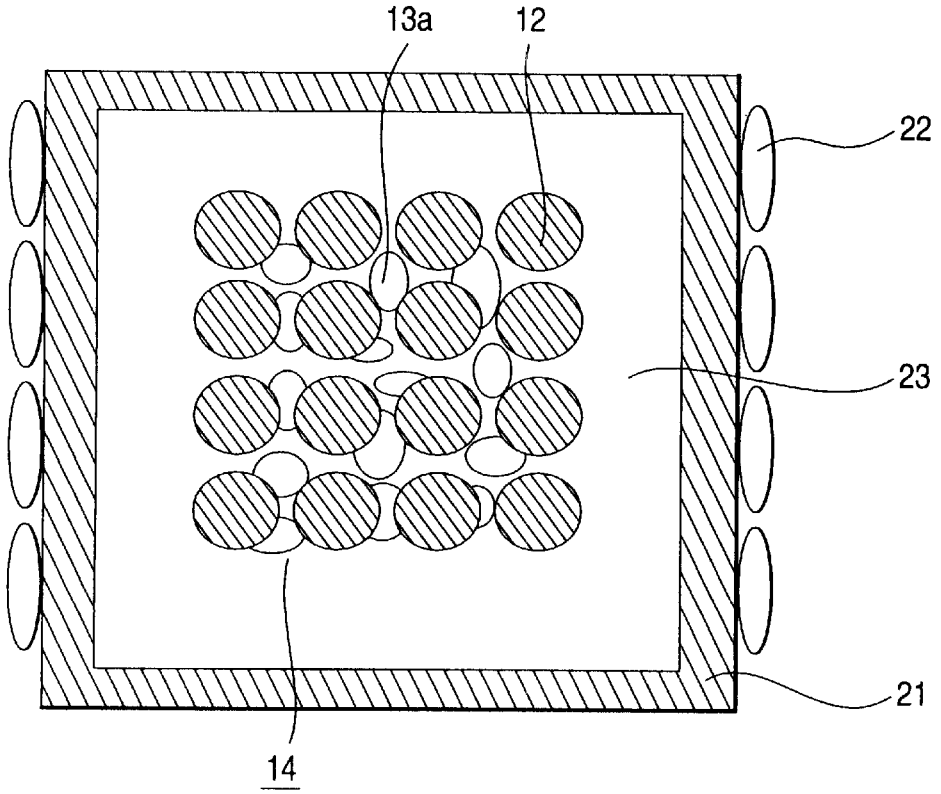

FIG. 1 is a diagram showing a method of manufacturing an electrode for discharge surface treatment according to a first embodiment of the present invention. In this embodiment, a process for manufacturing an electrode for discharge surface treatment made from powder obtained by mixing WC powder and Co powder as an example will be described. Referring to FIG. 1, reference numeral 11 represents a green compact, 12 represents WC powder, 13 represents Co powder, 13*a* represents Co powder, a portion of which has been melted, 14 represents an electrode for discharge surface treatment, 21 represents a vacuum furnace, 22 represents a high-frequency coil and 23 represents a vacuum atmosphere.

Figure 2:
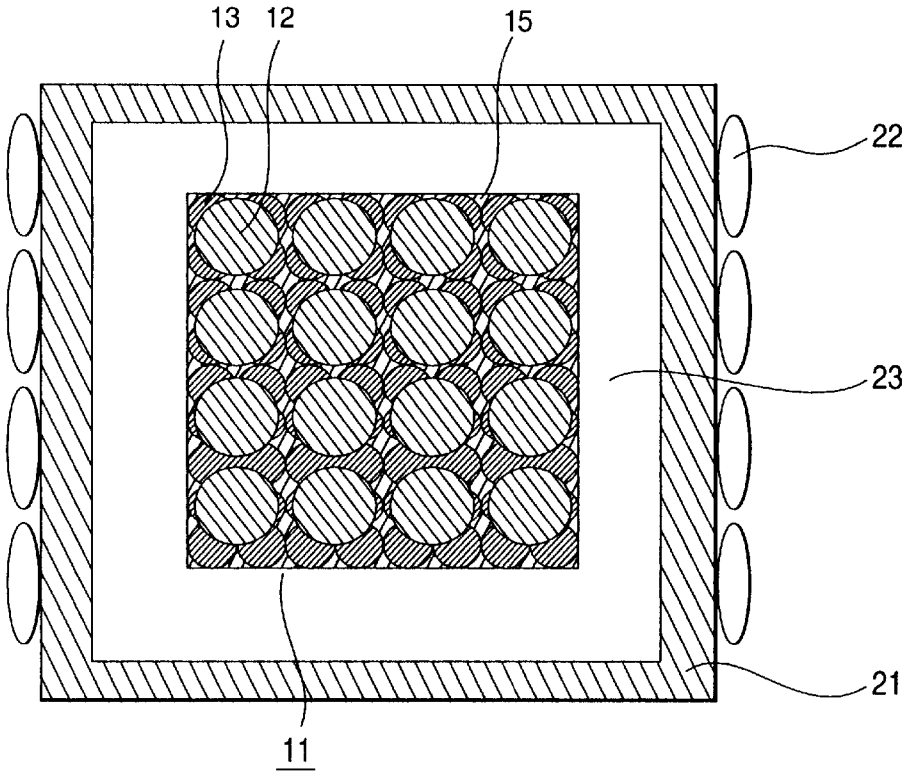
FIG. 2 is a diagram showing a method of forming the electrode for discharge surface treatment according to the first embodiment of the present invention by mixing wax in the material of the electrode.
Figure 2:
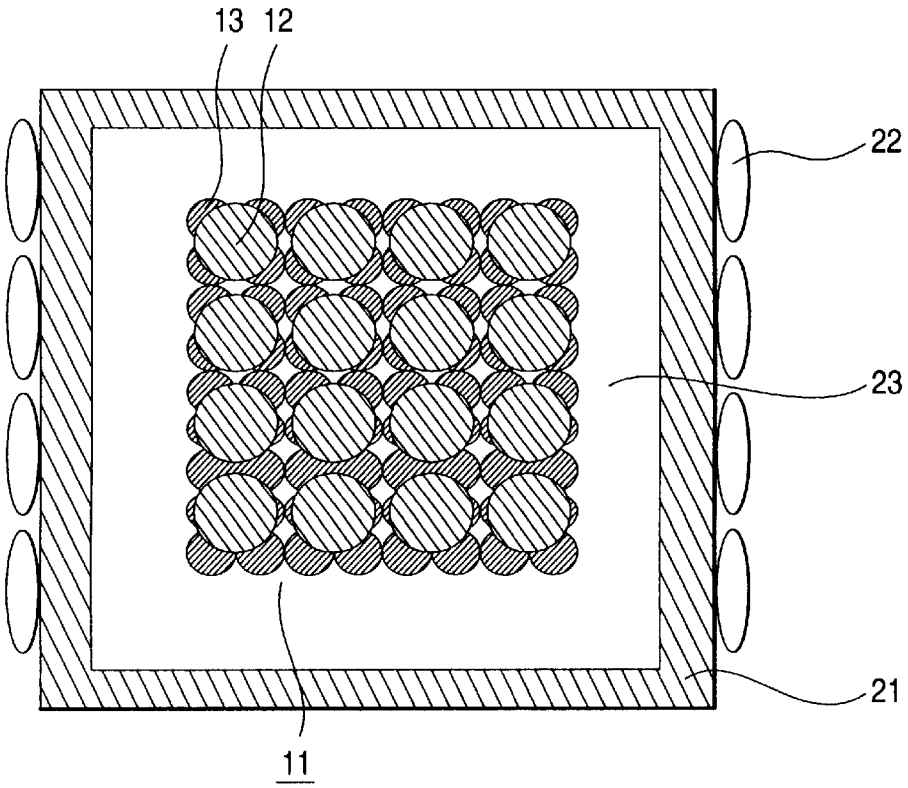
Figure 3:
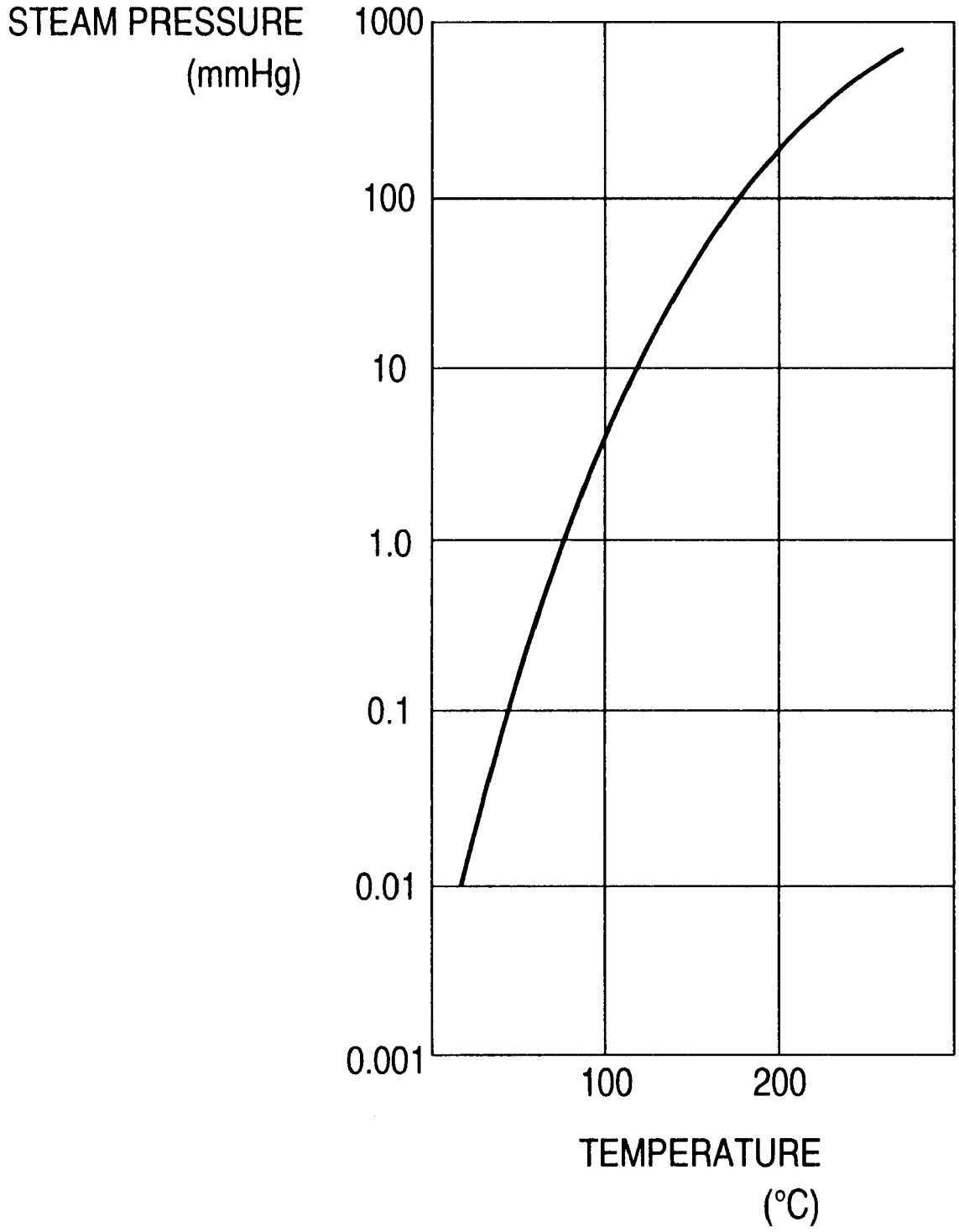
FIG. 3 is a graph showing an example of a steam pressure curve of the wax.

The green compact 11 obtained by mixing and compression-forming the WC powder and the Co powder may be obtained by simply mixing and compression-forming the WC powder 12 and the Co powder 13. It is preferable that a wax is mixed with the powders and then compression-forming is performed because the formability of the green compact 11 can be improved. This forming method will now be described with reference to FIG. 2. Reference numeral 15 represents a wax, such as paraffin, in the green compact 11 placed in the vacuum furnace 21 shown in FIG. 2(*a*). When the wax 15 is mixed with the powder obtained by mixing the WC powder 12 and the Co powder 13 before compression forming is performed, the formability of the green compact 11 can substantially be improved. Since the wax 15 is, however, an insulating substance, leaving the same in the electrode in a large quantity raises the electrical resistance of the electrode. Thus, the discharging characteristic deteriorates. Therefore, the wax 15 must be removed. FIG. 2(*a*) shows a state in which the electrode in the form of the green compact with wax mixed in is introduced into the vacuum furnace 21 so as to be heated. The heating operation is performed in the vacuum atmosphere 23. As an alternative to this, the atmosphere may be a gas, such as a hydrogen gas or an argon gas. The green compact 11 placed in the vacuum furnace 21 is heated by the high-frequency coil 22 disposed around the vacuum furnace 21. If the heating temperature is too low, the wax 15 cannot be removed. If the heating temperature is too high, the wax 15 is undesirably formed into soot. As a result, the purity of the electrode deteriorates. Therefore, the temperature must be not lower than the temperature at which the wax 15 is melted and not higher than the temperature at which the wax 15 is decomposed and soot is formed. A steam pressure curve of wax having a boiling point of 250° C. is shown in FIG. 3 as an example. When the atmospheric pressure in the vacuum furnace 21 is made to be not higher than the steam pressure of the wax 15, the wax 15 is evaporated and removed as shown in FIG. 2(*b*). As a result, the green compact 11 made of WC and Co can be obtained.

Then, the green compact 11 in the vacuum furnace 21 is heated by the high-frequency coil 22, as shown in FIG. 1(*a*) to impart strength with which durability against machining can be obtained to the green compact 11. To prevent an excessive degree of hardening, baking is performed to a hardness of, for example, a chalk (hereinafter referred to as "incomplete-sintering"). In the foregoing state, melting of metal, such as Co, starts to fill the gaps between the carbide particles. Thus, a state of solid solution of the carbide is formed. On the other hand, in the portions in which carbide comes into contact with other carbide, bonding proceeds. However, compared with the complete-sintering temperature (selected for the baking operation by the high frequency coil 22 mentioned above), the incomplete sintering temperature is comparatively low, and since at this temperature the green compact cannot result in complete-sintering, incomplete-sintering causes weak bonds to be formed.

The baking operation for realizing the incomplete-sintering is performed under temperature conditions which are varied depending on the material of the electrode. The conditions can be determined in advance in accordance with the results of experiments. In an example case where WC powder and Co powder are mixed (weight ratio=8:2) with each other so as to be compression-formed, the incomplete-sintering can be realized by baking the mixture at 600° C. for one hour. When TiC powder and $TiH_2$ powder are mixed (weight ratio=9:1) with each other and compression-formed, the incomplete-sintering can be realized by performing baking the mixture at 900° C. for one hour.

As described above, the temperature at which baking is performed to realize the incomplete-sintering must be set at which a portion of a soft material (for example, Co powder), which is employed as a binder with respect to a hard material (for example, WC powder), is melted. The foregoing temperature is considerably lower than the melting point of the hard material. The temperature varies in accordance with the mixture ratio of the hard material and the soft material. That is, if the ratio of the soft material employed to serve as the binder with respect to the hard material is raised, the baking temperature for realizing the incomplete-sintering must be lowered. If the ratio of the soft material serving as the binder is raised and, thus, the ratio of the hard material is lowered, the efficiency of forming the hard coating on the workpiece deteriorates. Therefore, the ratio of the soft material serving as the binder has a limit from a viewpoint of practical use. Therefore, the baking temperature for realizing the incomplete-sintering has a lower limit. That is, it is preferable that the baking temperature for realizing the incomplete-sintering is 400° C. or higher.

It is a furthermore important fact that the baking temperature for realizing the incomplete-sintering must be lower than 1100° C. If the temperature is higher than the above-mentioned level, the electrode is hardened excessively. In this case, during the discharge process a problem is caused in that the material of the electrode is non-uniformly separated due to a heat shock caused by the arc discharge and, therefore, the material of the electrode is not supplied normally to the space between the poles. As a result, the quality of the coating formed on the work excessively deteriorates.

The electrode for discharge surface treatment which has been compression-formed and then baked so as to be brought to the incomplete-sintering can easily be machined by a mechanical removing process, such as a turning operation, a grinding operation or a polishing operation or a discharging process. Moreover, the rate at which the hard coating is formed on a workpiece by the discharge surface treatment using the foregoing electrode is not lowered.

Second Embodiment

Figure 4:
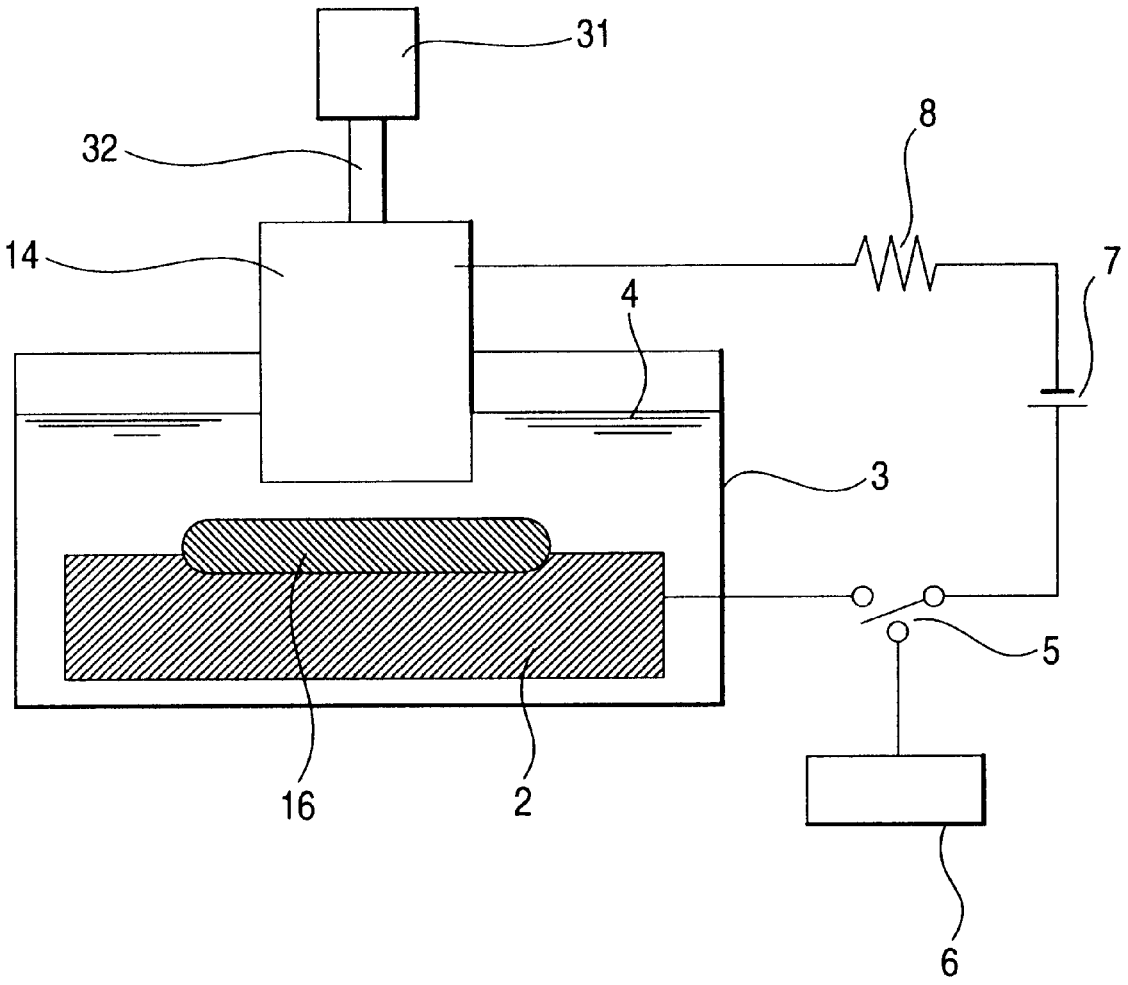
FIG. 4 is a diagram showing the schematic structure of a discharge surface treatment method and an apparatus therefor according to a second embodiment of the present invention.

FIG. 4 is a schematic diagram showing the structure of a discharge surface treatment method and an apparatus therefor according to a second embodiment of the present invention. Referring to FIG. 4, reference numeral 14 represents an electrode for discharge surface treatment and 16 represents a hard coating formed on a workpiece 2. Reference numeral 31 represents a feeding motor and 32 represents a feeding screw. Reference numeral 3 represents a working tank, 4 represents a working fluid composed mainly of oil having an insulation characteristic or water and 5 represents a switching element for switching voltage and current applied to the electrode 14 for discharge surface treatment of the workpiece 2. Reference numeral 6 represents a control circuit for controlling the switching element 5. Reference numeral 7 represents a power source and 8 represents a resistor. The electrode 14 for discharge surface treatment is an electrode compression-formed and baked to a incomplete-sintering similar to that described according to the first embodiment. A control unit (not shown) permits the feeding motor 31 to feed the electrode 14 for discharge surface treatment to the workpiece 2 in a required control mode including servo feeding and constant-speed feeding.

The working fluid 4 is composed mainly of oil having the insulating characteristic or water. When insulating oil is used as the working fluid 4, advantages can be realized in that widely used techniques about the discharge machine can be directly applied and the mechanical structure can be comparatively simplified. When water is employed as the working fluid, hydroxide is sometimes simultaneously produced with the reaction. Therefore, there sometimes arises a problem when a high-quality film is required. When a widely used electroless power source for a wire discharging machine is used, the foregoing problems can be overcome. Even in a case where water is employed as the working fluid, a hard coating having characteristics which are, from a viewpoint of practical use, the same as those obtained where insulating oil is used as the working fluid.

A method of forming the hard coating 16 will now be described. When intermittent or continuous arc discharge is generated by the power source 7 between the electrode 14 and the workpiece 2, the space between the poles are locally heated due to heat that is generated. In order to simplify the description, a process using a pulse-shape, intermittent arc discharge will now be described. When a typical power source is used as a means for generating the intermittent arc discharge, the structure can be easily understood. Note that the waveform, the value of the current and the other conditions must be optimized, if necessary. When a single arc discharge is generated, the heat shock energy causes a portion of the material of the electrode 14 opposite to the workpiece 2 to be separated into the space between the poles and simultaneously discharged as power. The space between the poles is momentarily brought to a hot plasma state, the temperature is thousands of degrees centigrade or higher. Thus, a major portion of the material of the electrode is brought to a completely melted state. Also the surface of the workpiece disposed opposite to the electrode at a position at which the arc discharge has been generated is momentarily heated. Thus, the workpiece surface is also brought into a melted state similar to the material of the electrode. In this hot state, the molten material of the electrode and the workpiece are mixed with each other. Thus, an alloy phase between the material of the electrode and the base material of the workpiece is formed on the workpiece. Then, the working fluid between the poles causes the surrounding temperature to rapidly decrease. During the cooling process of the alloy from the hot state to the cold state, interface reactions momentarily take place between the liquid iron alloy and the solid carbide. Therefore, complete-sintering takes place in a very short time. Thus, the hard coating 16 is formed on the workpiece 2. When the foregoing process is repeated, a fusing reaction between the surface of the formed hard coating and the material of the electrode is repeated. As the time elapses, deposition of the coating proceeds so that a thick film is formed.

To stably maintain the arc discharge a servo between the poles must be performed when an actual process is performed. The servo between the poles is an operation for maintaining a predetermined gap between the electrode and the workpiece, or a predetermined voltage between the poles which is required when the process is performed. Also, feed control is required after the electrode has been consumed is included. To maintain a predetermined gap between the poles, which varies as time elapses, or to maintain a predetermined voltage between the poles, feeding of the electrode must be preformed. The foregoing sequential control operation is called "servo between poles".

Figure 5:
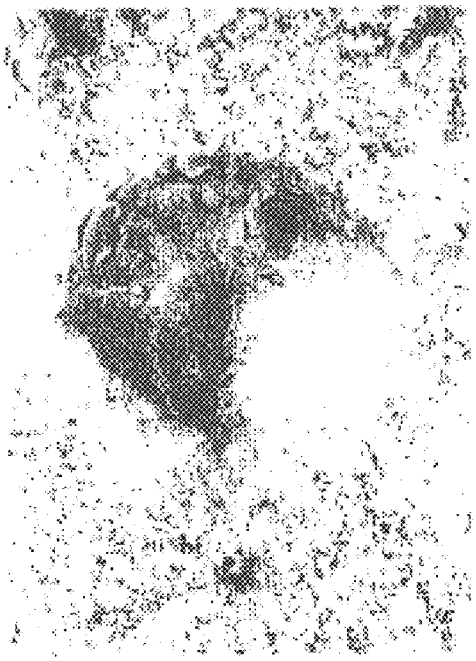
FIG. 5 is an enlarged photograph showing a hard coating formed by single discharge using TiC as the main component of the electrode according to the second embodiment of the present invention.
Figure 5:
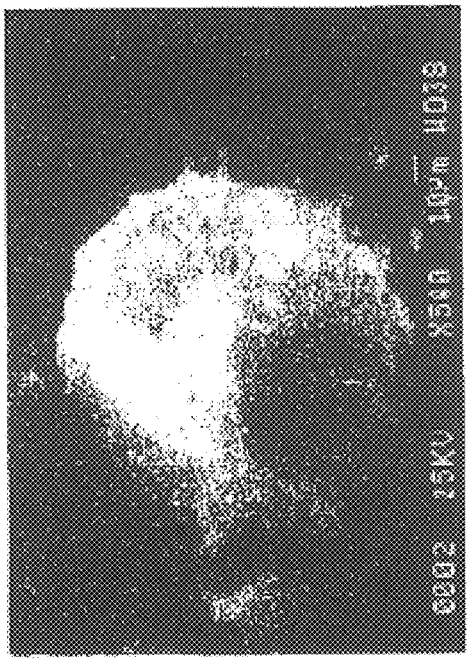
Figure 6:
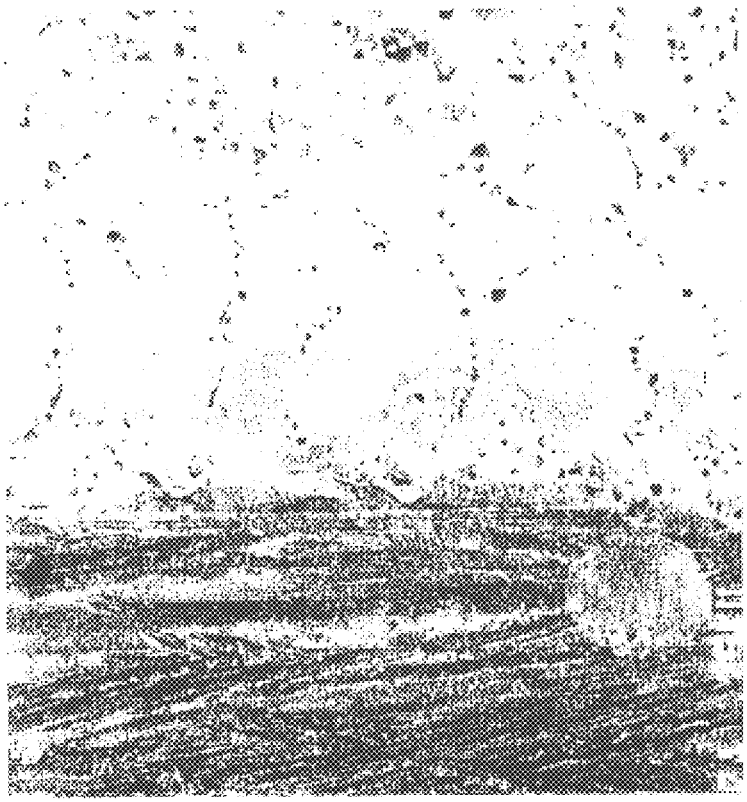
FIG. 6 is a photograph showing a state of deposition of a hard coating formed by continuous discharge according to the second embodiment of the present invention.

FIG. 5 is an enlarged photograph of a hard coating formed by a single discharge where the main component of the electrode is TiC. Also, as determined from the results of an analysis of the X-ray diffraction (to be described later), the hard coating was formed due to a momentary reaction. FIG. 6 shows a state of deposition of the hard coating formed by continuous discharge. A state in which hard coatings have been formed by single discharge is superimposed and deposits can be clearly observed. As described above, the electrode is compression-formed and baked so as to be brought to the incomplete-sintering and is used to cause arc discharge to continuously take place. Thus, the hard coating can be formed on the base material of the workpiece.

The hard coating can momentarily be formed due to a single discharge. Also continuous arc discharge permits a hard coating to be formed. The intermittent discharge is effective to prevent the temperature of the workpiece from rising. On the other hand, the temperature of the surface of the workpiece is comparatively low, causing the density of the hard coating to be somewhat insufficient. To prevent the foregoing problem, generation of the continuous arc discharge is required. In this case, concentration of arc discharge to one point takes place, causing a defect to occur in the machining operation. Therefore, stable arc discharge is generated while a high temperature is being maintained and servo between the poles is performed by combining the continuous arc discharge and the intermittent arc discharge. Arc discharge set to be performed at intervals of several $\mu$ seconds and continuous arc discharge which is performed for several seconds are combined with each other. When the foregoing combination is optimized according to the forming condition of the hard coating, a denser coating can quickly and reliably be deposited.

Figure 7:
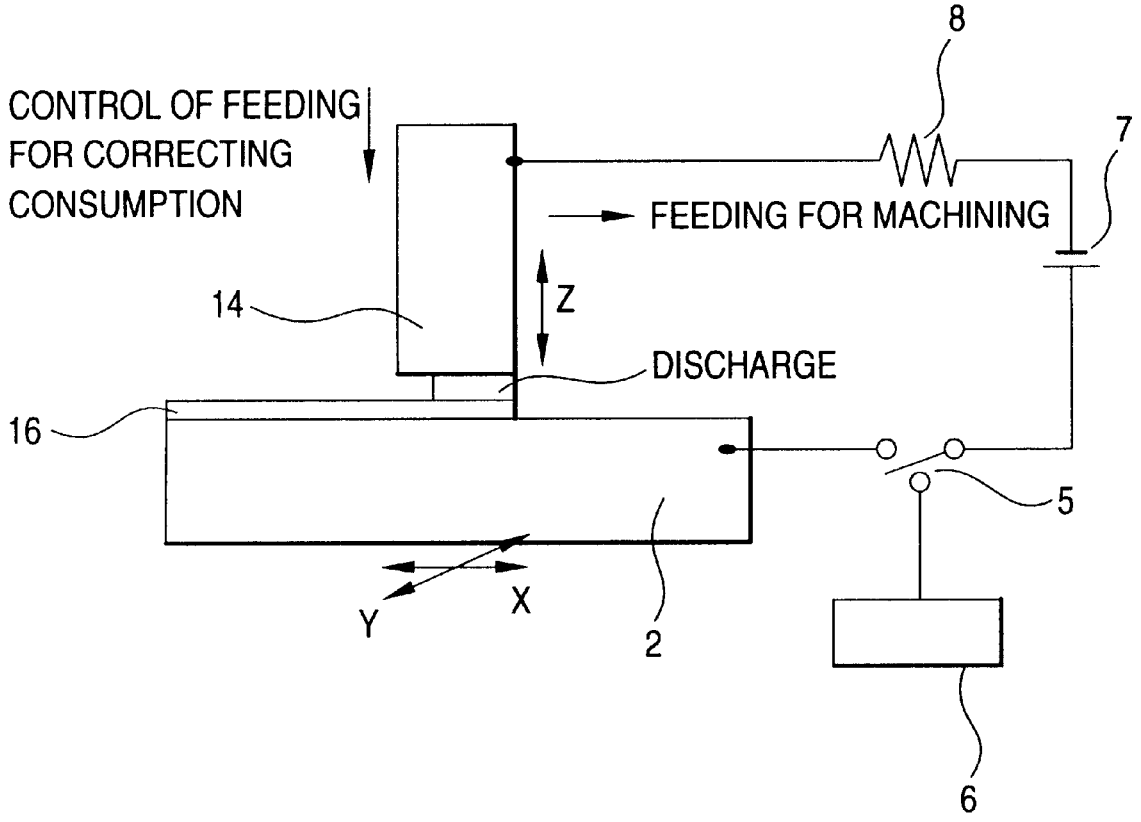
FIG. 7 is a schematic diagram showing a machining method employing an electrode scanning method according to the second embodiment of the present invention.

The method according to the present invention permits the hard coating to be deposited in an area of the workpiece which is substantially the same area as the area of the electrode. This advantage is unattainable with the other methods and is an excellent characteristic of the present invention. The conventional physical evaporation and chemical evaporation requires a masking process, such as plating, to perform a partial process. The method according to the present invention does not require the masking process, that is, only previous formation of an electrode having a required cross sectional area and machining are required. In a case where a large area must be machined, a small-size electrode may be used such that machining is performed while scanning the electrode similar to the milling process. Therefore, a large-size and special-shape electrode is not required. The concept of a machining method using the electrode scanning method is shown in FIG. 7. An X-axis moving unit, a Y-axis moving unit and a Z-axis moving unit (not shown) are operated to move the electrode 14 and the workpiece 2 in the X, Y and Z directions respectively. Thus, the hard coating 16 is formed on the surface of the workpiece 2. In a case where the workpiece 2 is a mold, the surface of the mold is not a flat surface, that is, the surface is a complicated free curved surface in a three-dimensional shape. The X-axis moving unit, the Y-axis moving unit and the Z-axis moving unit permit the small-size electrode to scan the mold such that the gap from the free curved surface of the mold is maintained or predetermined servo voltage is maintained. In this case, the electrode is quickly consumed. Therefore, feeding to correspond to the consumption of the electrode must be performed. Thus, the movement of the main shaft for supporting the electrode in the Z direction must accurately and quickly be controlled. The foregoing operation is repeated until the electrode has scanned along the entire curved surface of the mold. As a result, the hard coating can be deposited to have a predetermined thickness over the surface of the mold or various thicknesses to meet a specific requirement.

The function of the working fluid will now be described. Referring to FIG. 4, the working fluid 4 is interposed between the electrode 14 and the workpiece 2. The reason why the working fluid 4 is interposed lies in that 1) discharge must be stabilized to maintain the machining operation, 2) heat generated owing to the discharge must be removed and 3) a portion of the material of the electrode which cannot be used to form the hard coating on the workpiece must be removed from the space between the poles. Therefore, the foregoing working fluid has important functions. Note that the working fluid 4 is different from that of the conventional technique because it does not have the function of supplying a raw material necessarily for producing a product of reactions. Therefore, the working fluid 4 does not provide any essential materials needed for a proper reaction to take place.

Figure 8:
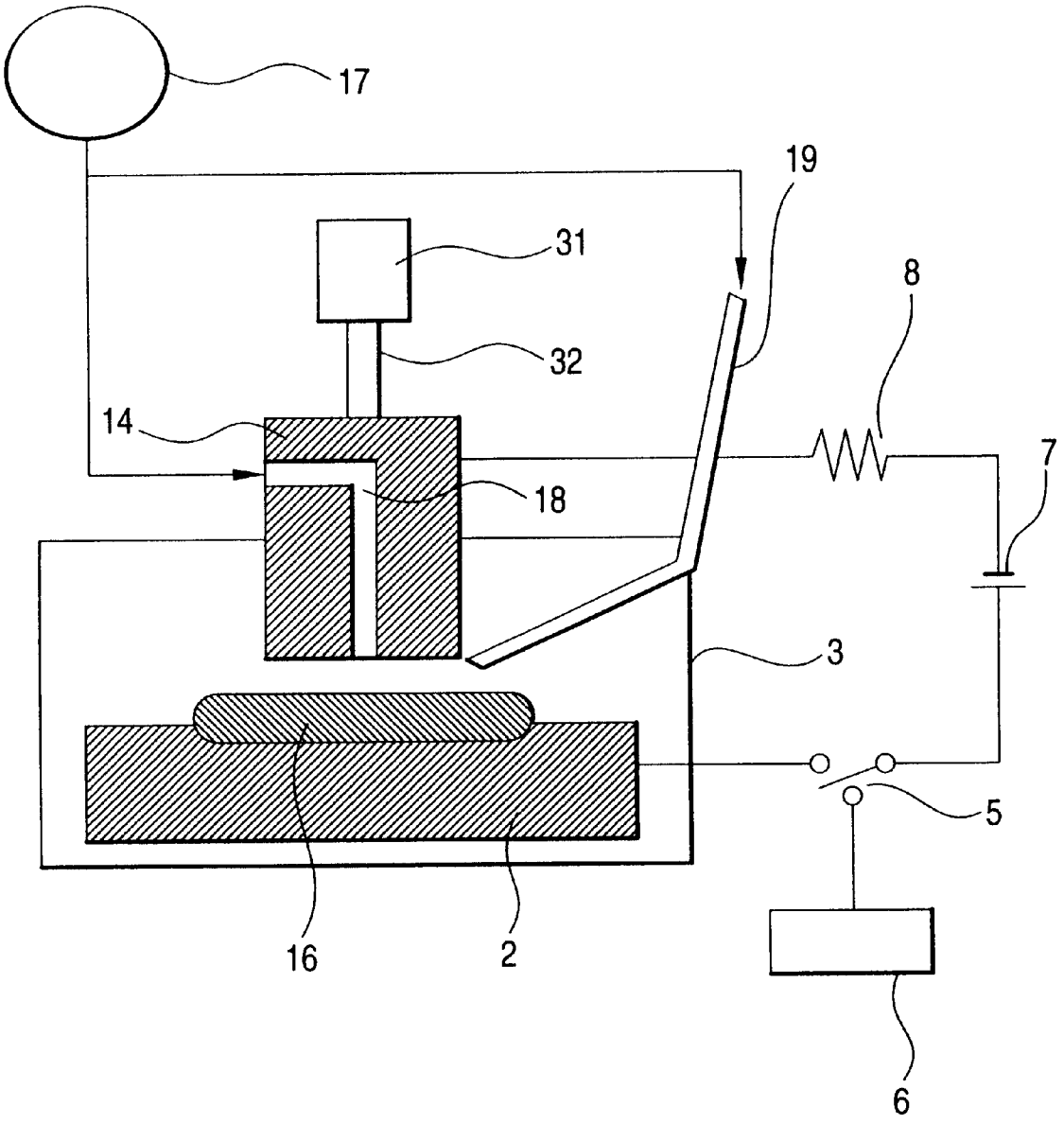
FIG. 8 is a diagram showing a discharge surface treatment method according to the second embodiment of the present invention with which aerial discharge is performed.

Since the working fluid is not an essential element as described above, aerial discharge may be performed. A discharge surface treatment method using an aerial discharge will now be described. Referring to FIG. 8, reference numeral 17 represents a gas source connected to a passage 18 formed in the electrode 14 through a pipe. While electric power is supplied from the power source 7, air or a non-reactive gas, such as a nitrogen gas, is supplied from the gas source 17 in a required quantity. A supply pipe 19 is an example which is used to supply the gas from an outside portion of the electrode in a case where the passage cannot be formed in the electrode. Thus, the gas is jetted out toward the space between the poles. The gas is supplied for the same purpose of the foregoing working fluid. If the gas supply is not performed, formation of the hard coating on the work cannot stably be performed. It is preferable that the gas is air or a nitrogen gas from a viewpoint of environmental friendliness.

Figure 9:
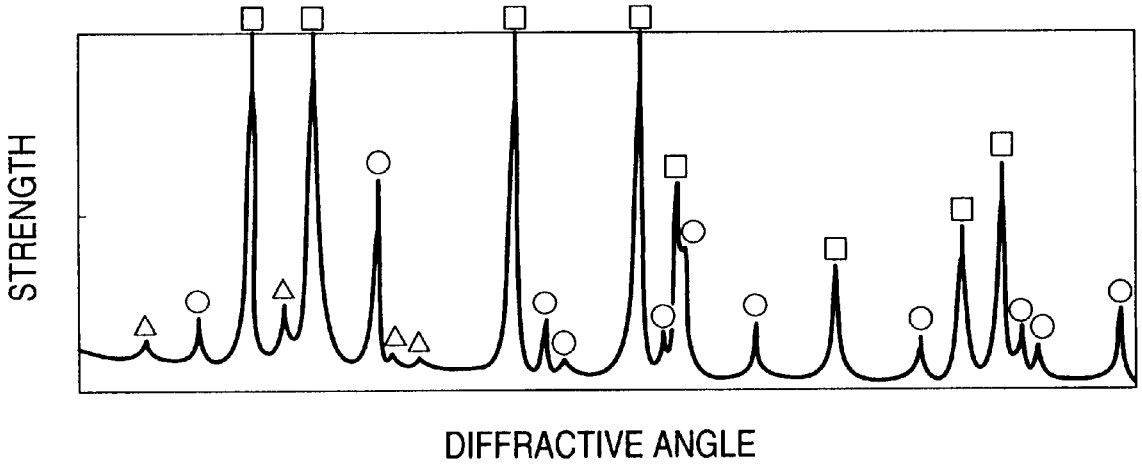
FIG. 9 shows results of X-ray diffraction of the hard coating formed on a work by using an electrode according to the second embodiment of the present invention and baked such that an incomplete-sintering state mainly composed of TiC is realized.
Figure 10:
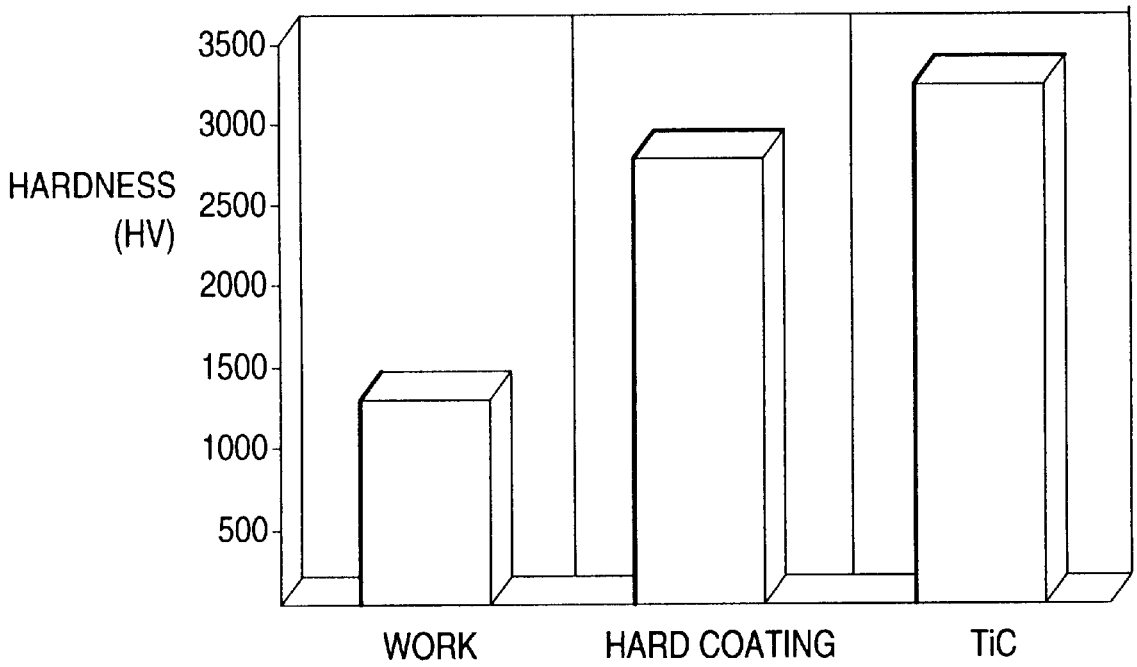
FIG. 10 is a graph showing results of Vickers hardness measurements of the formed hard coating according to the second embodiment of the present invention.

The representative characteristics of the formed hard coating will now be described by using obtained experiment data. FIG. 9 shows the results of X-ray diffraction of the hard coating in which an electrode, compression-formed with TiC, and baked so as to be brought to the incomplete-sintering is used to form the hard coating on the workpiece made of WC. On the surface of the workpiece, there are deposits of TiC which is the main component of the electrode, and WC which is the material of the workpiece. FIG. 10 shows the results of measurement of the Vickers hardness of the formed hard coating. The hardness of the workpiece (base material) is about 1300, while the hard coating has a hardness of about 2800. Thus, the hardness is increased. Therefore, the fact that the main component of the hard coating is TiC can be confirmed. Also the hardness of TiC is shown in FIG. 10 for reference.

Third Embodiment

A method of forming a hard coating according to a third embodiment will now be described which is capable of imparting special functions including lubricity, strength against high temperatures and wear resistance.

Mixing of a material having a self-lubricating function will now be described. In general, each of Mo, BN and Cr has a self-lubricating function. When the foregoing powder material is mixed in the material of the electrode (the electrode being of similar construction as explained in the previous embodiment) at a predetermined ratio, the material having the self-lubricating function is mixed and confined in the hard coating formed on the workpiece. When the surface of the foregoing hard coating is ground, the lubricity can be imparted to the ground surface without any lubricating means or with oil supply in a very small quantity due to the self-lubricating characteristic of the material. As described above, an ideal state is realized such the surface is made of the material of the hard coating and the material having the self-lubricating function. As a result, a sliding portion exhibiting satisfactory durability and having a low friction coefficient can be realized.

Figure 11:
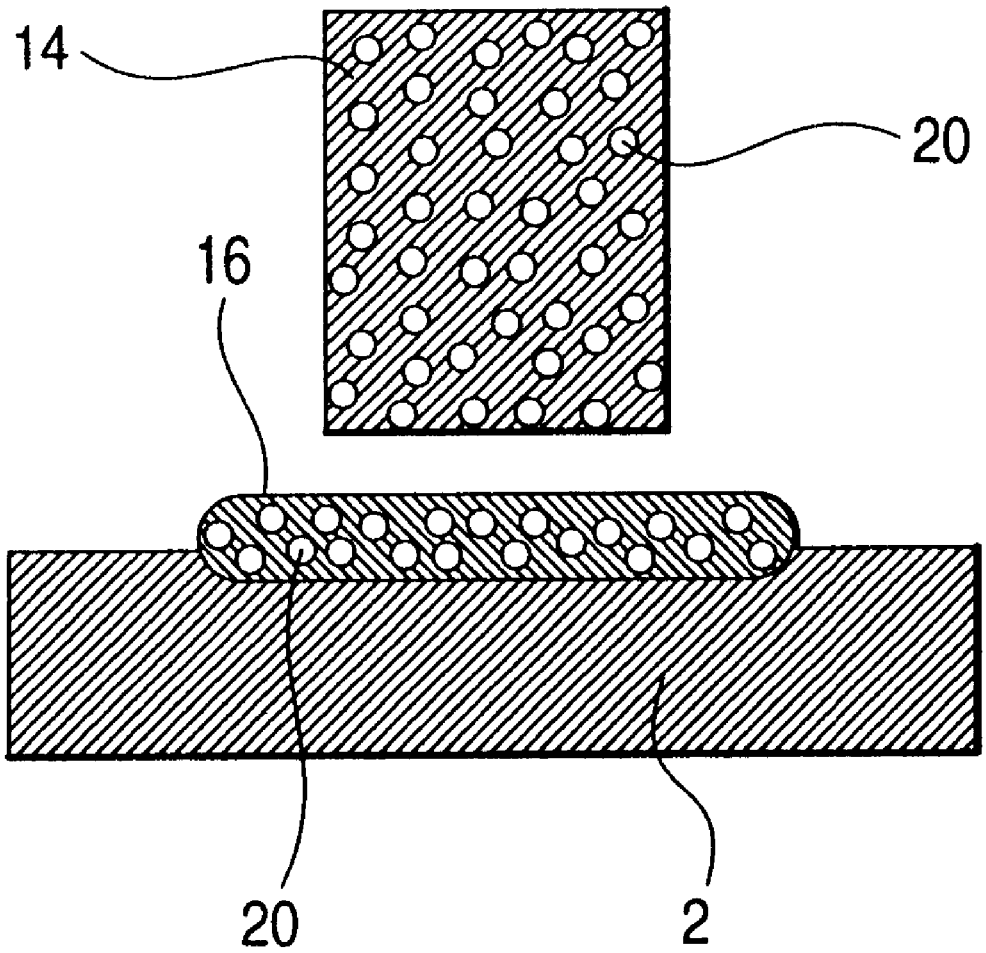
FIG. 11 is a diagram showing a method of forming a hard coating according to a third embodiment of the present invention and capable of providing special functions.

Referring to FIG. 11, reference numeral, 20 represents a granular mixed substance having a granulation size which is, for example, two or more times the average granulation size of the main material component of the electrode and smaller than the distance between the poles. The heat decomposition of the granular mixed substances 20 does not take place even at high temperatures and must be confined in the hard coating in its original shape. The size of granulation of the granular mixed substances 20 must be enlarged to prevent the formation of a solid solution with the other carbide. The solid solution cannot be formed when the size of the granular is at least two times the average granulation size of the main component. When the granulation size is enlarged, separation from the electrode takes place and, therefore, the space between the poles is clogged in a direction toward the workpiece. In the foregoing case, short circuit takes place. Therefore, the size of granulation of the mixed substances 20 must also be smaller than the gap between the poles.

Now, a mixture of ceramics will now be described. Alumina ($Al_2O_3$) has excellent characteristics at high temperatures. Therefore, when alumina is mixed at a predetermined ratio, the strength against high temperatures and wear resistance can be considerably improved. Since alumina in a single state has no conductivity, it cannot be deposited on the workpiece by the discharge surface treatment. When discharge is generated by an electrode obtained by mixing alumina in the material of the electrode, the hard coating can be formed on the workpiece. Simultaneously, alumina is mixed into the hard coating. To obtain the characteristics of alumina, decomposition of alumina occurs due to the arc discharge must be prevented. Therefore, it is preferable that alumina is formed into blocks each having a certain size (see FIG. 11) and mixed in the electrode 14. When the size is about several $\mu$m to tens of $\mu$m, alumina is able to endure high temperatures for a very short time and then it is cooled rapidly. Therefore, alumina in the form of blocks is confined in the hard coating on the workpiece. The thus-formed coating has a two-phase structure comprising the hard coating (formed by cooling the liquid phase) and the blocks of alumina (which are not formed into the solid solution). Therefore, the characteristics of the two phases can be obtained.

Further, mixing of nitride, such as TiN, will now be described. The main object of mixing the nitride, such as TiN, in the hard coating is to improve tenacity and heat resistance. Since the foregoing nitride has no conductivity, single nitride cannot form a hard coating by the arc discharge. If an electrode is used which is obtained by mixing nitride at a mixture ratio at which the conductivity can be maintained in the material of the electrode; discharge machining is permitted. Similar to the mixing of alumina, decomposition can take place at high temperatures. The heat decomposition must be prevented by using an electrode obtained by the steps of 1) confining grains each having a comparatively large size (tens of $\mu$m as shown in FIG. 11) in the electrode; 2) performing compression-forming; and 3) baking to realize the incomplete-sintering. When arc discharge is caused to occur by using the foregoing electrode, the blocks of nitride are confined in the hard coating formed on the workpiece. Therefore, a hard coating is formed in which the hard coating and the nitride blocks coexist. The foregoing coating has both the characteristics of the hard coating, and the characteristics of the nitride (which are excellent tenacity and satisfactory strength against high temperatures). Therefore, excellent performance can be exhibited when the foregoing coating is applied to a cutting tool or a mold.

Fourth Embodiment

A discharge surface treatment method according to a fourth embodiment of the present invention and capable of forming, on a workpiece, a denser hard coating having excellent quality and free from irregularities will now be described.

The conventional hard coating made of a hard alloy is formed by sintering a green compact, at a temperature not lower than a temperature at which a liquid phase appears, for a long time in a vacuum furnace or the like. The method of forming the hard coating by using the arc discharge according to the present invention is structured to perform very short durations of the reactions and form the hard coating (main sintering) at a very high temperature not lower than the sintering temperature in the vacuum furnace. Therefore, there is apprehension that the hard coating may have incomplete characteristics.

A method of overcoming the above-mentioned problem will now be described. Initially, grains (blocks each having a size of tens of $\mu$m) of a hard alloy obtained by sintering is mixed with the material of the electrode in a predetermined quantity. Then, the electrode is compression-formed, and then baked to produce the incomplete-sintering electrode. The thus-manufactured electrode is used to perform discharge machining. A powder electrode component and a solid electrode component are simultaneously discharged to the space between the poles. The powder electrode component is formed into the liquid phase due to the high temperature, and then cooled to form the hard coating. Since the temperature of the solid electrode component is not raised sufficiently, the solid characteristic is maintained. Therefore, a hard coating containing the solid component can be formed. The thus-formed hard coating has a denser tissue, free from hardness irregularities, and excellent characteristics as compared with the hard coating which is formed using an electrode made only of powder.

Fifth Embodiment

Figure 12:
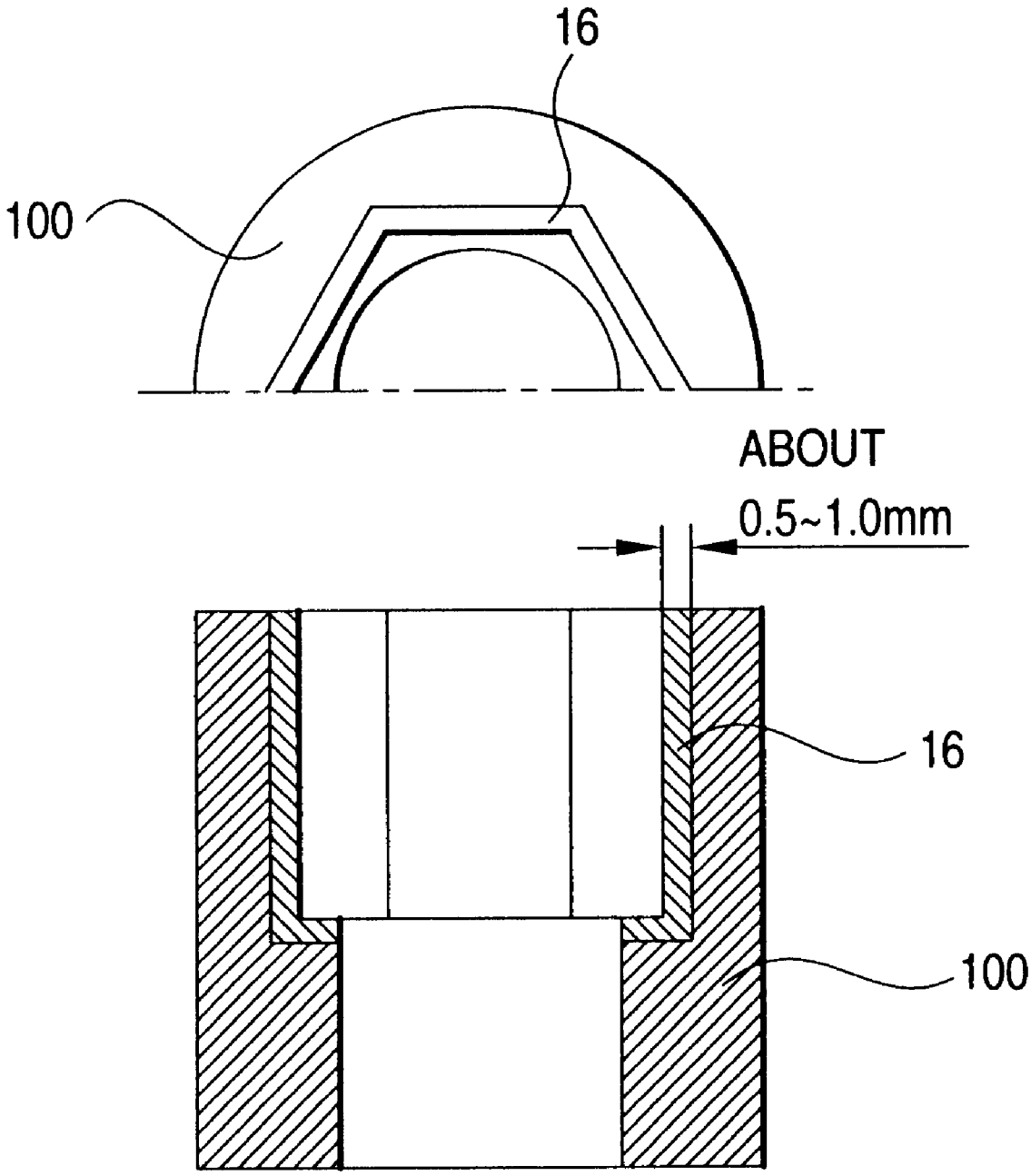
FIG. 12 is a diagram showing a state in which a discharge surface treatment method according to a fifth embodiment of the present invention is applied to a precisely-forged mold.
Figure 17:
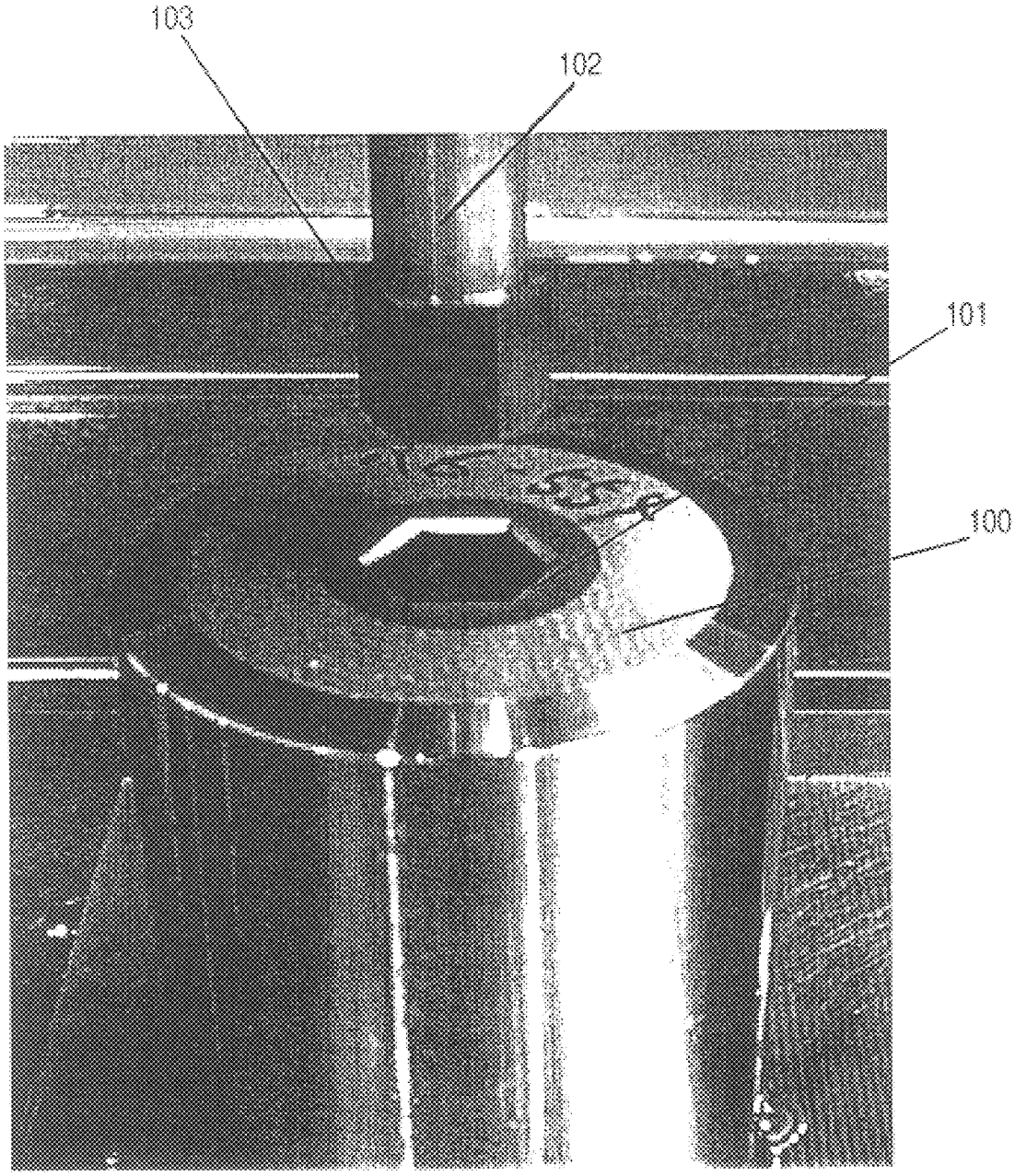
FIG. 17 is a photograph showing a mold for a die header which is used as a conventional mold manufactured by precise forging.
Figure 18:
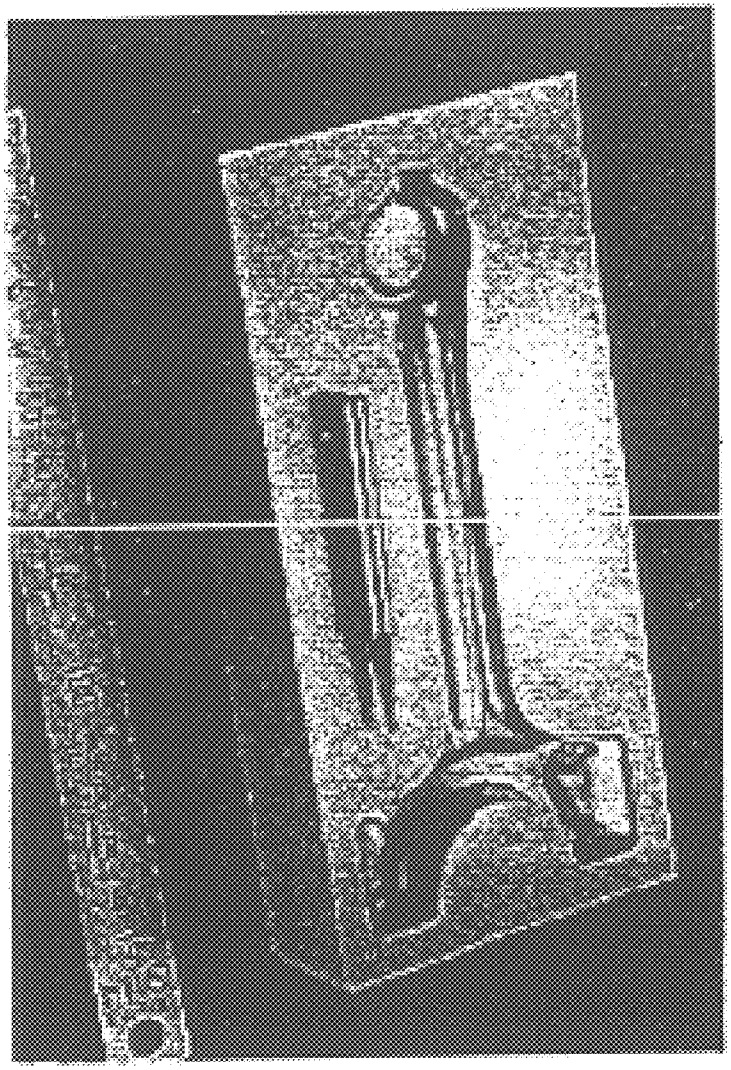
FIG. 18 is a photograph showing a conventional forged mold for a connecting rod.
Figure 19:
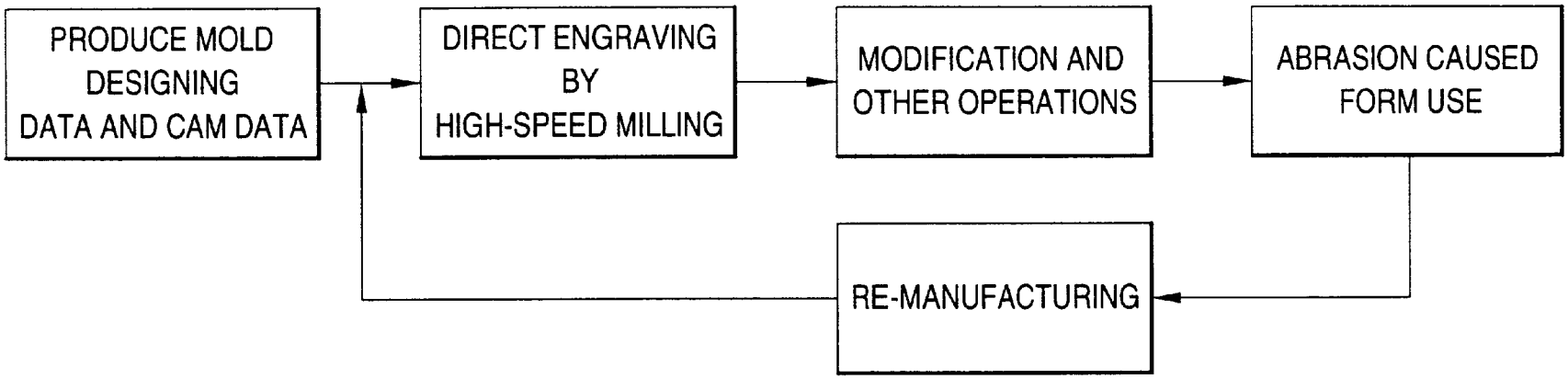
FIG. 19 is a diagram showing an example of a conventional process for manufacturing a mold.
Figure 20:
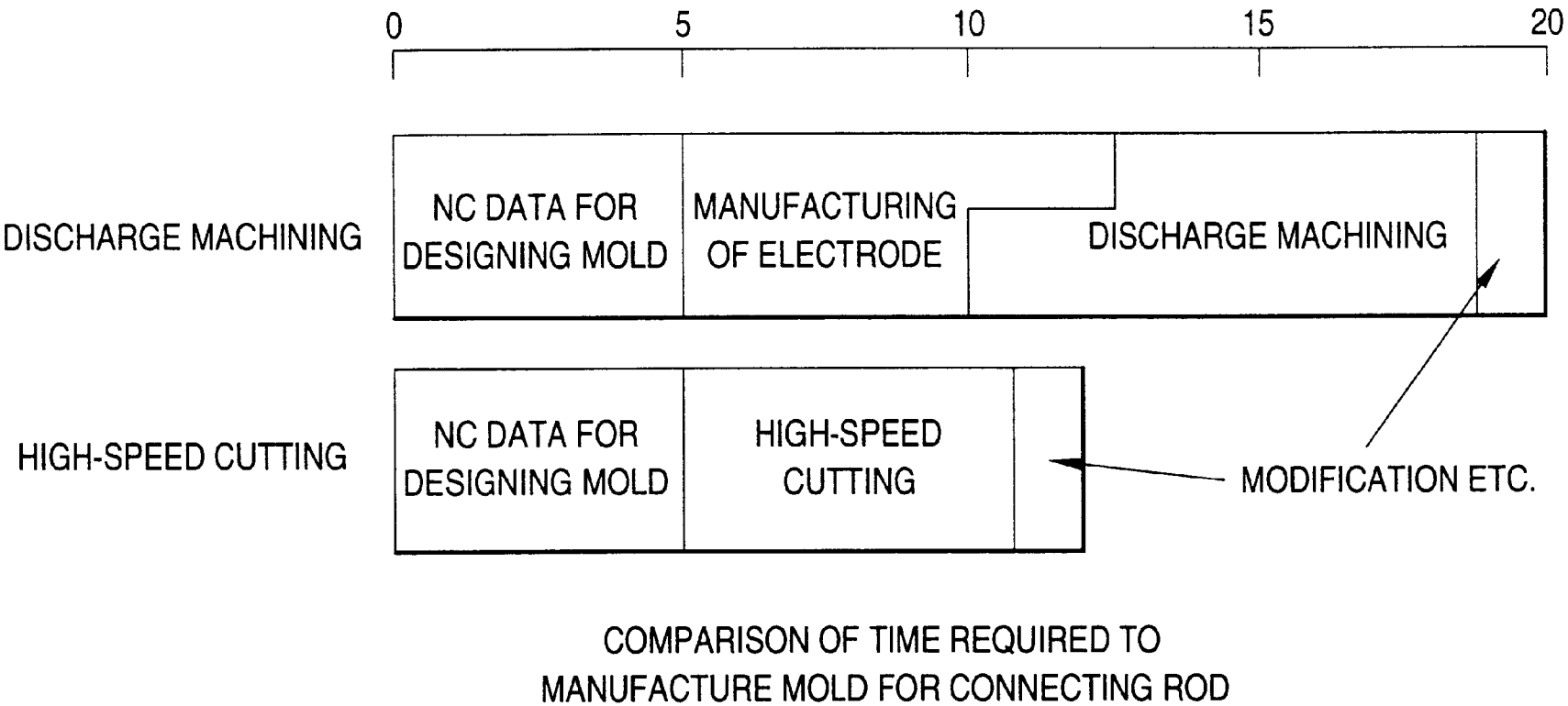
FIG. 20 is a graph showing results of a comparison of time required to manufacture a mold for a connecting rod between a conventional discharge machining and a method of using high-speed cutting.
Figure 21:
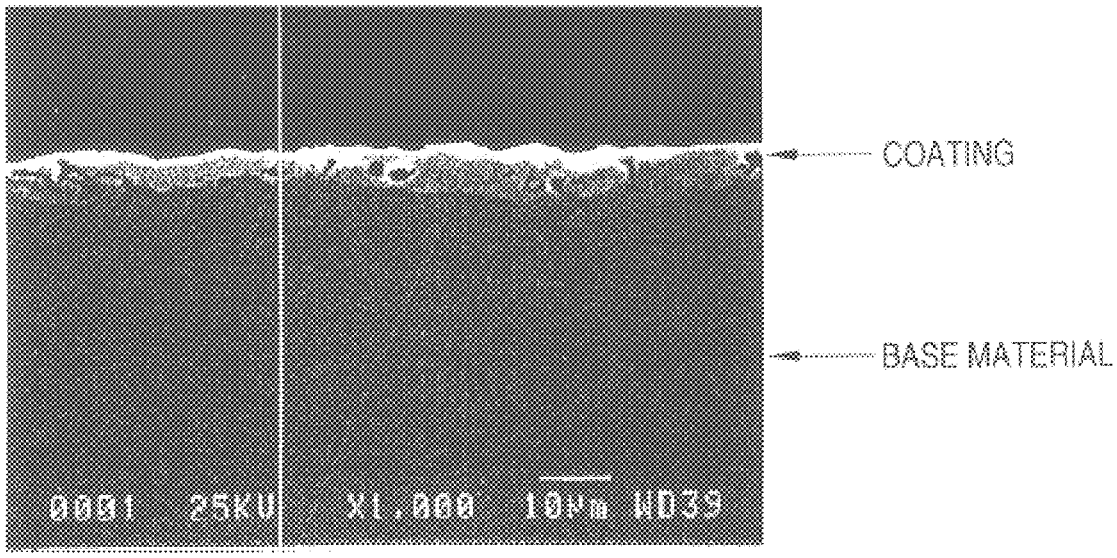
FIG. 21 is a photograph showing a coating formed by a conventional discharge surface treatment.

FIG. 12 is a diagram showing a state in which the discharge surface treatment method according to the present invention is applied to a mold structured as shown in FIG. 17 and formed by precise forging. Referring to FIG. 12, reference numeral 16 represents a hard coating formed on the surface of a base material 100 of the mold. The base material 100 of the mold is previously machined by a machining operation. In the case shown in FIG. 12, a hexagonal hole is formed by machining. Usually, the base material 100 of the mold is not subjected to heat treatment. Although heat treatment in a lowest degree is sometimes performed, the hard coating is made to be comparatively low, for example, Rockwell hardness (scale C) HRC=about 30. The reason for this lies in that machinability required to perform the machining process must be maintained. If the hardness is higher than the above-mentioned value, excessive abrasion of the tool takes place, causing the cost of manufacturing the mold to increase. Then, a thick hard coating is formed on the surface of the base material of the mold. The method is the same as that according to the second embodiment shown in FIG. 7 so that the hard coating is formed on the workpiece. The thickness of the hard coating is about 0.5 mm to about 1.0 mm from a viewpoint of practical use. Then, discharge machining, using a copper electrode or a graphite electrode or a wire discharge machining is performed to the mold's required dimensions.

The mold shown in FIG. 12 has substantially the same quality as that of the mold shown in FIG. 17 and a long lifetime can be realized.

The foregoing discharge surface treatment method has an advantage in that application to a mold is permitted regardless of the size and the shape of the mold.

Figure 13:
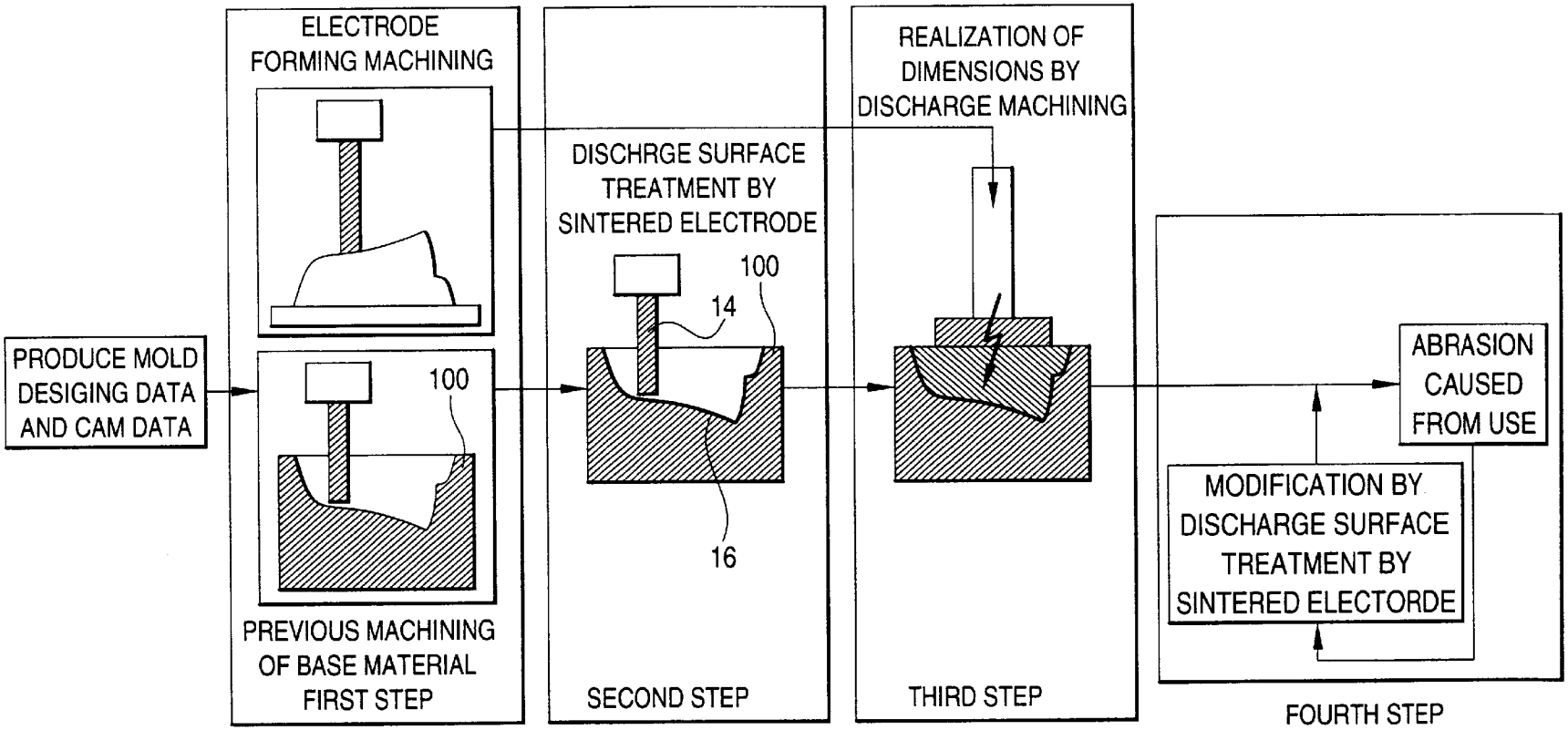
FIG. 13 is a diagram showing a process for manufacturing and using the mold according to the fifth embodiment of the present invention.

FIG. 13 shows a process for manufacturing a mold structured as shown in FIG. 12. A first step performed is machining the base material of the mold and forming the electrode. Then, the second step of discharge surface treatment using an electrode according to the first to fourth embodiments is performed. Thus, an operation for depositing a hard coating on the surface of the mold which has previously been machined is performed. In the foregoing case, the hard coating may be deposited to have a thickness of several mm to prepare for a secondary machining operation. Then, in a third step, discharge machining is performed as a secondary machining operation to realize the required dimensions of the mold. Then, the manufactured mold is actually used. The foregoing mold having the thick hard coating exhibits significant durability. After the mold has been used many times, abrasion or partial breakage of the mold sometimes occur. Therefore, the discharge surface treatment in the fourth step by using the electrode baked to the incomplete-sintering enables only the broken portion to be repaired. Thus, the foregoing mold can be used again. Hence, re-manufacturing of the mold is not required. When the fourth step is repeated, the mold can be semipermanently used. In the case of a large-size mold, the manufacturing cost of which is very large, the manufacturing cost and maintaining cost can be considerably saved. Since the quantity of the material for manufacturing the mold can be considerably reduced, an optimum method can be obtained from an energy saving and environmental friendliness viewpoint.

Sixth Embodiment

Figure 14:
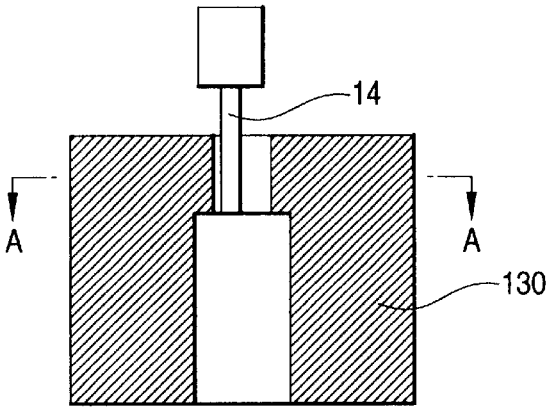
FIG. 14 is a diagram showing application of a sixth embodiment of the present invention to a pressing mold.
Figure 14:
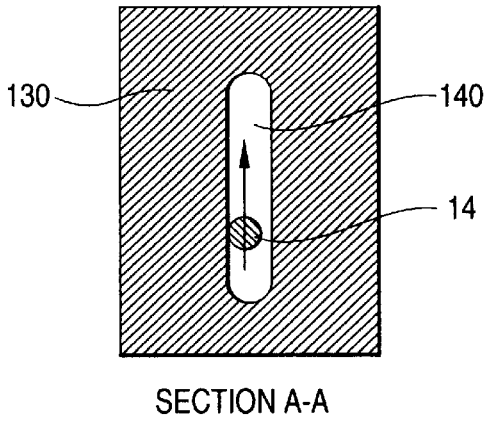
Figure 14:
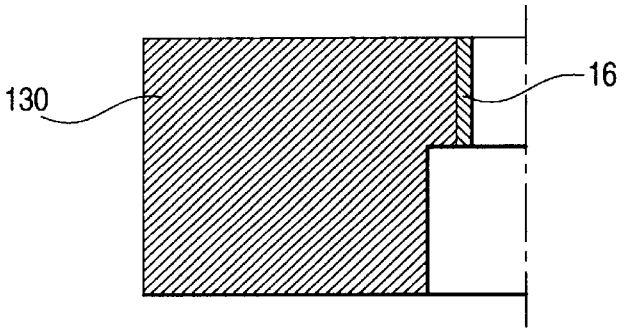
Figure 14:
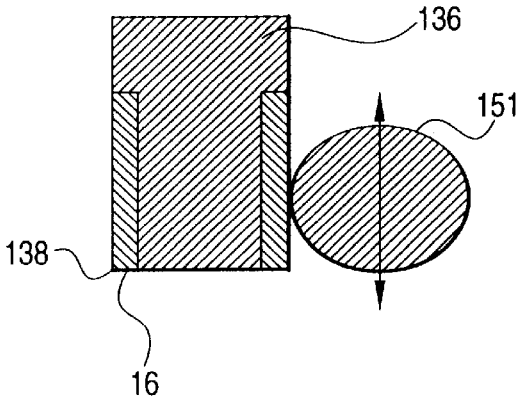
Figure 14:
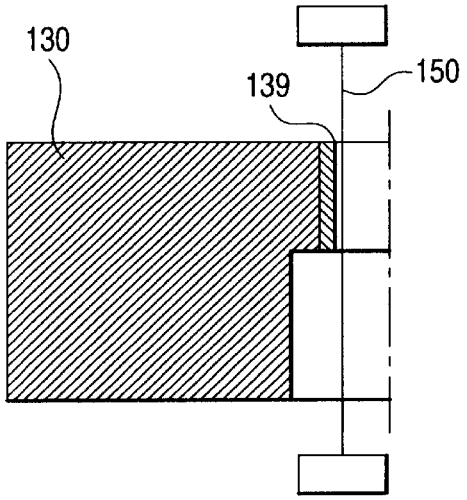

FIG. 14 shows a sixth embodiment of the present invention, in which the present invention is applied to a pressing mold. As shown in FIGS. 14(*a*) and (*b*), an electrode 14 formed according to the first to fourth embodiments is used to subject the inside portion of a cutting blade 140 of a die to a discharge surface treatment. As shown in FIG. 14(*c*), a hard coating 16 is formed. Also the hard coating is formed on the outer surface of a punch 136 and the edge of a cutting blade 138 of the punch shown in FIG. 14(*d*). Then, as shown in FIG. 14(*e*), a wire electrode 150 is used to perform discharge-machining of a cutting blade 139 so that a predetermined dimension accuracy is realized. FIG. 14(*d*) shows an example in which a grinding operation is performed by using a grindstone 151 to finish the outer surface of the cutting blade 138. As described above, the electrode baked to be brought to the incomplete-sintering is used to perform the discharge surface treatment. Thus, a thick and hard coating can easily be formed on the surface of the mold in a short time. Then the secondary machining process is performed to realize the specified dimensions of the mold. As a result, a mold having high quality can be manufactured.

Seventh Embodiment

Figure 15:
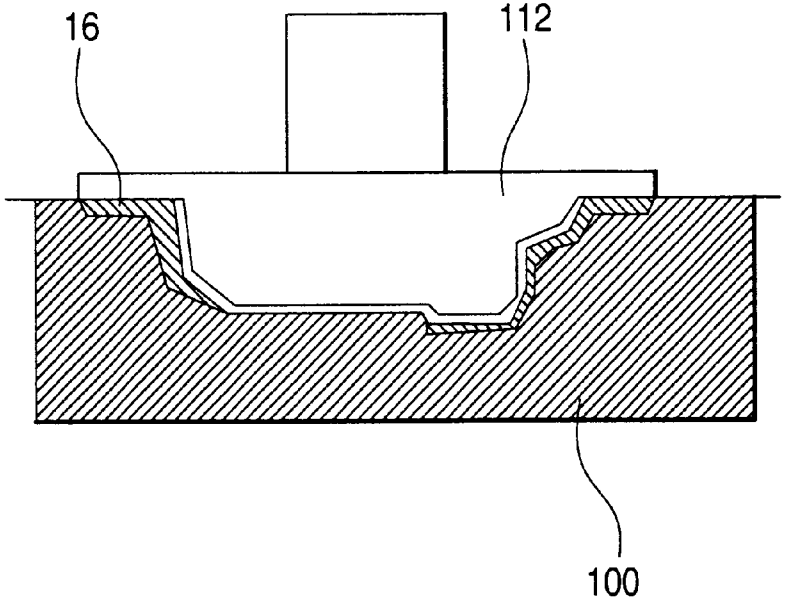
FIG. 15 is a diagram showing a method of changing the thickness of the hard coating in accordance with a degree of wear in order to elongate the lifetime of the mold according to a seventh embodiment of the present invention.
Figure 15:
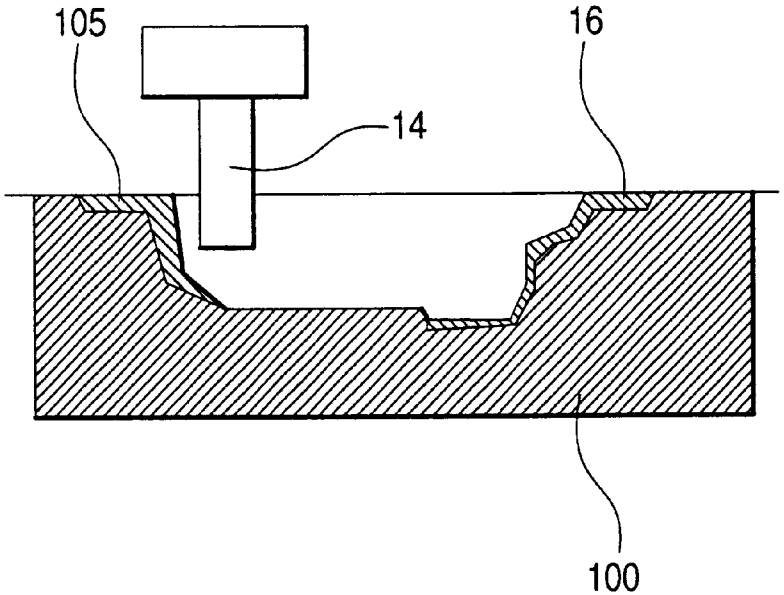
Figure 16:
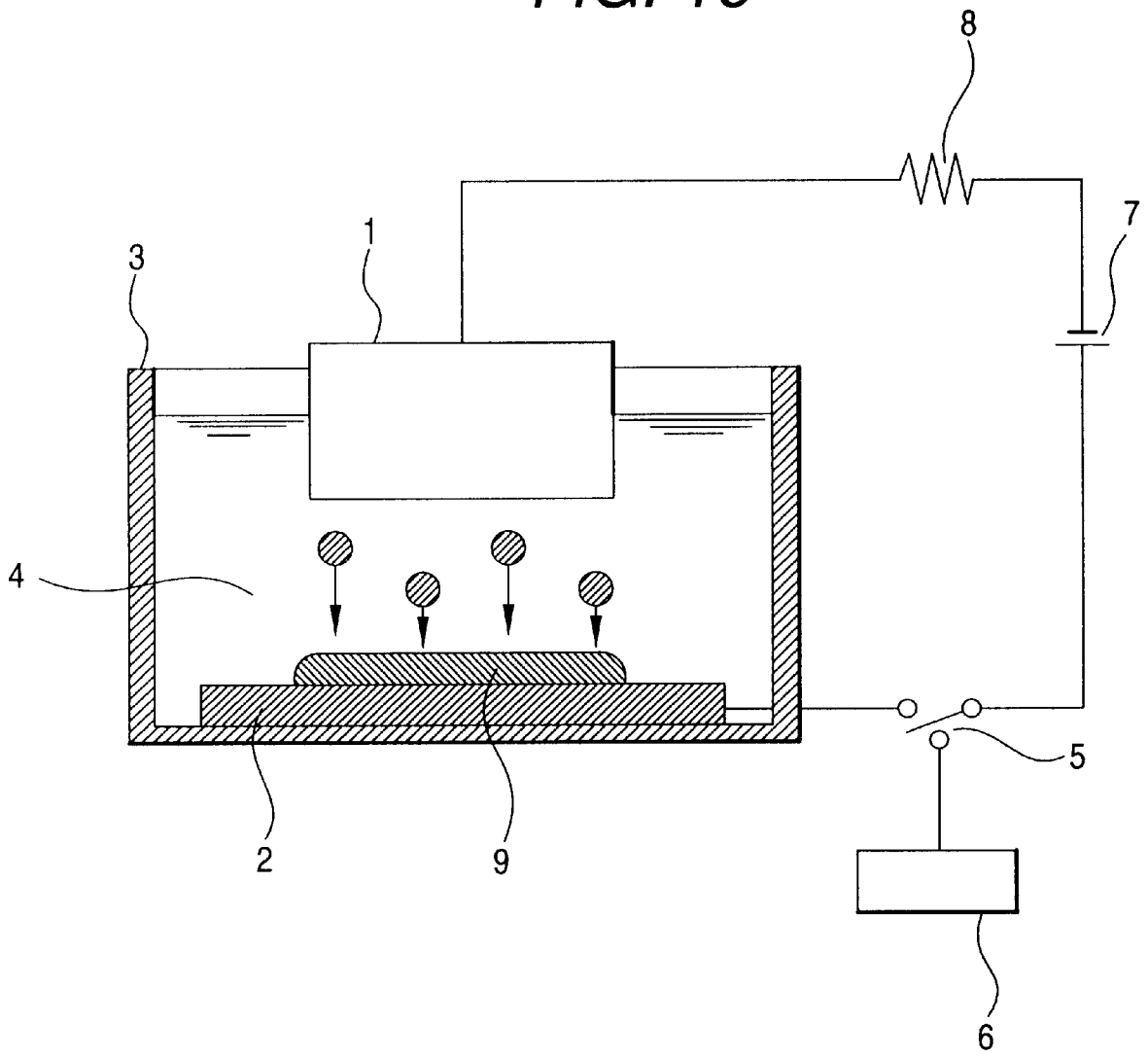
FIG. 16 is a diagram showing the structure of a conventional discharge surface treatment method.

A contrivance of application to a mold which is a seventh embodiment of the present invention will now be described. In an actual case, the worn portion is locally limited. Therefore, the local wear determines the lifetime of the mold. In such a case, the lifetime is improved by employing a method shown in FIG. 15. That is, as shown in FIG. 15(*a*), an upper surface (parting line) 105 and a portion adjacent to the inlet portion of the mold which are considerably worn, are coated with a thick coating. As a method capable of realizing this structure, a scanning method using the simple electrode shown in FIG. 7 or a method using a forming electrode 112 as shown in FIG. 15(*b*) may be used. When a compression load is exerted, the portion in the vicinity of the bottom surface of the mold is free from considerable wear in many cases. Therefore, a relatively thin coating may be employed or the coating may sometimes be omitted.

A method of manufacturing the profile electrode as shown in FIG. 15(*b*) will now be described. Initially, a mold is used to manufacture an electrode in the form of a green compact by compression-forming. Then, baking is performed to realize the incomplete-sintering so that a profile electrode, as shown in FIG. 15(*b*), is manufactured. Therefore, the time required to manufacture the electrode can considerably be shortened. To realize the foregoing effect, the previous machining operation must be performed in such a manner that the mold is finished in consideration of a thickness corresponding to the thickness of a coating which will be formed in a next discharge surface treatment process. Even if the mold, which is being used, is used to manufacture the profile electrode, a gap required in the discharge surface treatment, which is performed after the previous machining operation has been performed, can be maintained. When the profile electrode has previously been manufactured, local deposition of the hard coating can easily be permitted by performing the discharge surface treatment if the mold is worn. Therefore, modification of the mold can be completed in a very short time. Moreover, a necessity of manufacturing another mold for the purpose of manufacturing the profile electrode can be eliminated.

Industrial Applicability

As described above, the electrode for discharge surface treatment, the manufacturing method therefor, the discharge surface treatment method and the apparatus therefor according to the present invention are suitable to be used in an industrial field concerning the structure for forming a hard coating on the surface of a work.

What is claimed is:

1. An electrode for discharge surface treatment with which electrical discharge between the electrode and a workpiece is used to generate energy to form a coating on a surface of the workpiece, said electrode comprising:

a hard material which is made from metal powder, powder of a metal compound, powder of a ceramic material or a combination of said powders, and a binder having a lower melting temperature than said hard material;

wherein said hard material is harder than said binder;

wherein after said electrode has been formed by compression, baking is performed at an incomplete-sintering temperature at which a portion of the binder of said electrode is melted in order to partially fill gaps between particles of said hard material.

2. An electrode for discharge surface treatment with which electrical discharge between the electrode and a workpiece is used to generate energy to form a coating on a surface of the workpiece, said electrode comprising:

a hard material which is made from metal powder, powder of a metal compound, powder of a ceramic material or a combination of said powders, a binder having a lower melting temperature than said hard material; and wax;

wherein said hard material is harder than said binder;

wherein after said wax has been added to said hard material and said binder, forming is performed by compression, heating is performed to evaporate and remove said wax at a temperature at which said wax is melted but not decomposed or caused to soot, and then baking is performed at an incomplete-sintering temperature at which a portion of said binder is melted in order to partially fill gaps between particles of said hard material.

3. The electrode for discharge surface treatment according to claim 1 or 2, wherein baking is performed at an incomplete-sintering temperature not lower than 400° C. and lower than 1100° C.

4. The electrode for discharge surface treatment according to claim 1 or 2, wherein powder of a material having a self-lubricating function, powder of nitride or a combination thereof is mixed with said hard material and said binder before said electrode is formed by compression.

5. The electrode for discharge surface treatment according to claim 1 or 2, wherein sintered particles of an alloy are mixed with said hard material and said binder before said electrode is formed by compression.

6. A method of manufacturing an electrode for discharge surface treatment with which electrical discharge between the electrode and a workpiece is used to generate energy to form a coating on a surface of the workpiece, said method comprising the steps of:

mixing a hard material and a binder to form a mixture, wherein said hard material is made from metal powder, powder of a metal compound, powder of a ceramic material or a combination of said powders and said binder having a lower melting temperature than said hard material, wherein said hard material is harder than said binder;

compressing said mixture to form an electrode; and baking said electrode at an incomplete-sintering temperature at which a portion said binder is melted in order to partially fill gaps between particles of said hard material.

7. A method of manufacturing an electrode for discharge surface treatment with which electrical discharge between the electrode and a workpiece is used to generate energy to form a coating on a surface of the workpiece, said method comprising the steps of:

mixing a hard material and a binder to form a mixture, wherein said hard material is made from metal powder, powder of a metal compound, powder of a ceramic material or a combination of said powders and said binder having a lower melting temperature than said hard material, wherein said hard material is harder than said binder;

adding wax to said mixture, compressing said mixture to form an electrode; and heating said electrode to evaporate and remove said wax at a temperature at which said wax is melted but not decomposed or caused to soot, and baking said electrode at an incomplete-sintering temperature at which a portion of said binder is melted in order to partially fill gaps between particles of said hard material.

8. The method of manufacturing an electrode for discharge surface treatment according to claim 6 or 7, wherein baking is performed at an incomplete-sintering temperature not lower than 400° C. and lower than 1100° C.

9. The method of manufacturing an electrode for discharge surface treatment according to claim 6 or 7, wherein powder of a material having a self-lubricating function, powder of nitride, or a combination thereof is mixed with said hard material and said binder before said electrode is formed by compression.

10. The method of manufacturing an electrode for discharge surface treatment according to claim 6 or 7, wherein sintered particles of an alloy are mixed with said hard material and said binder before said electrode is formed by compression.

11. A discharge surface treatment method with which electrical between an electrode and a workpiece is used to generate energy to form a coating on a surface of the workpiece, said method comprising the steps of:

mixing a hard material and a binder to form a mixture, wherein said hard material is made from metal powder, powder of a metal compound, powder of a ceramic material or a combination of said powders and said binder having a lower melting temperature than said hard material, wherein said hard material is harder than said binder;

compressing said mixture to form an electrode; and baking said electrode at an incomplete-sintering temperature at which a portion-said binder is melted in order to partially fill gaps between particles of said hard material; and causing arc discharge to occur between said electrode and said workpiece so that energy of said arc discharge is used to form the coating on the surface of said workpiece, wherein said arc discharge can be a intermittent arc discharge, a continuous arc discharge or combination of said continuous arc discharge and said intermittent arc discharge.

12. The discharge surface treatment method according to claim 11, wherein said baking is performed at an incomplete-sintering temperature not lower than 400° C. and lower than 1100° C.

13. The discharge surface treatment method according to claim 11, wherein a non-reactive gas is interposed between said electrode and said workpiece.

14. The discharge surface treatment method according to claim 11, wherein said electrode scans said workpiece to form said coating on the surface of said workpiece.

15. The discharge surface treatment method according to claim 11, wherein powder of a material having a self-lubricating function, powder of nitride, or a combination thereof is mixed with said hard material and said binder before said electrode is formed by compression.

16. The discharge surface treatment method according to claim 11, wherein sintered particles of an alloy are mixed with said hard material and said binder before said electrode is formed by compression.

17. The discharge surface treatment method according to claim 11, wherein said workpiece is a mold having a previously applied coating on a surface of a base material of said mold, and wherein said previously applied coating is repaired by discharging a new coating in locations of said previously applied coating which need repair.

18. The discharge surface treatment method according to claim 17, wherein said new coating is thicker than the previously applied coating so that highly worn portions of said previously applied coating are thicker than portions with little wear.

19. The discharge surface treatment method according to claim 17, wherein a portion of said mold in which abrasion has occurred is repaired by performing discharge surface treatment using said electrode.

20. The discharge surface treatment method according to claim 19, wherein a forming electrode is manufactured by using said base material of said mold subjected to said previous machining, and said portion of said mold in which abrasion has occurred is repaired by performing discharge surface treatment which uses said forming electrode.

21. A discharge surface treatment apparatus for causing discharge to occur between an electrode and a workpiece is used to generate energy to form a coating on a surface of the workpiece, said discharge surface treatment apparatus comprising:

discharge generating means for generating arc discharge between said electrode and said workpiece, wherein said arc discharge is intermittent arc discharge, continuous arc discharge or a combination of said continuous arc discharge and intermittent arc discharge; and wherein said electrode further comprises:

a hard material which is made from metal powder, powder of a metal compound, powder of a ceramic material or a combination of said powders, and a binder having a lower melting temperature than said hard material;

wherein said hard material is harder than said binder;

wherein after said hard material has been formed by compression, baking is performed at an incomplete-sintering temperature at which a portion of the binder of said electrode is melted in order to partially fill gaps between particles of said hard material.

22. The discharge surface treatment apparatus according to claim 21, wherein baking is performed at an incomplete-sintering temperature not lower than 400° C. and lower than 1100° C.

23. The discharge surface treatment apparatus according to claim 21, further comprising inert-gas supply means for interposing a non-reactive gas between said electrode and said workpiece.

24. The discharge surface treatment apparatus according to claim 21, further comprising an X-axis moving unit, a Y-axis moving unit and a Z-axis moving unit for relatively moving said electrode and said workpiece in an X direction, a Y direction and a Z direction.

* * * * *